US010145273B2

(12) United States Patent
Takada

(10) Patent No.: US 10,145,273 B2
(45) Date of Patent: Dec. 4, 2018

(54) CONTROL VALVE FOR VALVE TIMING CONTROL DEVICE AND VALVE TIMING CONTROL DEVICE FOR INTERNAL COMBUSTION ENGINE

(71) Applicant: HITACHI AUTOMOTIVE SYSTEMS, LTD., Hitachinaka-shi, Ibaraki (JP)

(72) Inventor: Yasuhide Takada, Atsugi (JP)

(73) Assignee: HITACHI AUTOMOTOVE SYSTEMS, LTD., Hitachinaka-Shi (JP)

( * ) Notice: Subject to any disclaimer, the term of this patent is extended or adjusted under 35 U.S.C. 154(b) by 99 days.

(21) Appl. No.: 15/124,470

(22) PCT Filed: Jan. 9, 2015

(86) PCT No.: PCT/JP2015/050457
§ 371 (c)(1),
(2) Date: Sep. 8, 2016

(87) PCT Pub. No.: WO2015/141245
PCT Pub. Date: Sep. 24, 2015

(65) Prior Publication Data

US 2017/0022854 A1 Jan. 26, 2017

(30) Foreign Application Priority Data

Mar. 19, 2014 (JP) ..... 2014-056300

(51) Int. Cl.
*F01L 1/46* (2006.01)
*F01L 1/344* (2006.01)
*F01L 1/047* (2006.01)

(52) U.S. Cl.
CPC ..... *F01L 1/3442* (2013.01); *F01L 1/047* (2013.01); *F01L 1/46* (2013.01);
(Continued)

(58) Field of Classification Search
CPC ..... F01L 2001/3443; F01L 2001/34433; F01L 2001/34453; F01L 1/46
(Continued)

(56) References Cited

U.S. PATENT DOCUMENTS 5,218,935 A * 6/1993 Quinn, Jr. ..... F01L 1/34409 123/90.17
7,389,756 B2 * 6/2008 Hoppe ..... F01L 1/34 123/90.15

(Continued)

FOREIGN PATENT DOCUMENTS

JP 2008-523294 A 7/2008
JP 2009-515090 A 4/2009

(Continued)

*Primary Examiner* — Jorge Leon, Jr.
(74) *Attorney, Agent, or Firm* — Foley & Lardner LLP

(57) ABSTRACT

A control valve is configured to reduce an axial length of a device as much as possible, thereby improving its mountability. The valve is equipped with a valve body functioning as a cam bolt for connecting a vane rotor to one end of a camshaft, a sleeve fixed to an inner peripheral surface of the valve body, and a spool valve element axially slidably housed in the sleeve for switching between supply and discharge of working fluid to and from each of a phase-retard working chamber and a phase-advance working chamber. The valve body has a male screw part formed on an outer peripheral surface and screwed into a female screw part formed in a cam bolt hole. The position of formation of the male screw part and the position of the spool valve element are arranged to overlap with each other in an axial cross-section.

14 Claims, 17 Drawing Sheets

(52) U.S. Cl.
CPC ..... *F01L 2001/3443* (2013.01); *F01L 2001/34423* (2013.01); *F01L 2001/34433* (2013.01); *F01L 2001/34453* (2013.01); *F01L 2001/34466* (2013.01); *F01L 2001/34469* (2013.01); *F01L 2250/02* (2013.01)

(58) Field of Classification Search
USPC ..... 123/90.17
See application file for complete search history.

(56) References Cited

U.S. PATENT DOCUMENTS

| | | | | |
|---|---|---|---|---|
| 2007/0095315 | A1 | 5/2007 | Hoppe et al. | |
| 2008/0245324 | A1 | 10/2008 | Hoppe et al. | |
| 2012/0073535 | A1* | 3/2012 | Hoppe | F01L 1/34 123/188.4 |
| 2012/0210962 | A1* | 8/2012 | Hoppe | F01L 1/344 123/90.17 |
| 2013/0068183 | A1 | 3/2013 | Takada | |
| 2013/0092113 | A1* | 4/2013 | Bohner | F01L 1/46 123/90.15 |
| 2013/0199469 | A1 | 8/2013 | Busse et al. | |

FOREIGN PATENT DOCUMENTS

| | | | |
|---|---|---|---|
| JP | 2013-064380 | A | 4/2013 |
| JP | 2014-040778 | A | 3/2014 |
| WO | WO-01/40633 | A1 | 6/2001 |

* cited by examiner

CONTROL VALVE FOR VALVE TIMING CONTROL DEVICE AND VALVE TIMING CONTROL DEVICE FOR INTERNAL COMBUSTION ENGINE

TECHNICAL FIELD

The present invention relates to a control valve used for a valve timing control device for variably controlling valve timings of intake valves and/or exhaust valves of an internal combustion engine depending on an operating condition.

BACKGROUND ART

Traditionally there have been proposed and developed various control valves used for a valve timing control device for an internal combustion engine. One such control valve has been disclosed in the following Patent document 1.

Briefly speaking, the control valve is equipped with a cylindrical valve body inserted and arranged in a vane rotor fixed to one axial end of a camshaft from the axial direction, a cylindrical sleeve fixedly connected into the valve body, a spool valve element axially slidably disposed in the sleeve, a valve spring for biasing the spool valve element in one axial direction, and a solenoid part for pushing the spool valve element in the other axial direction against the spring force of the valve spring.

The valve body is formed of a metal material and configured to function as an axially elongated cam bolt. The valve body is comprised of a cylindrical main valve-body part arranged on one end side and a small-diameter, cylindrical male screw-threaded structural part arranged at the other end side and formed integral with the main valve-body part.

The sleeve, the spool valve element, and the valve spring are all disposed inside of the main valve-body part. A male screw is formed on the outer peripheral surface of the top end side of the male screw-threaded structural part.

Also formed in the one axial end of the camshaft is a stepped insertion hole comprised of a large-diameter hole in which the main valve-body part of the valve body is inserted and arranged, and a small-diameter hole in which the male screw-threaded structural part is inserted. A female screw, with which the male screw is threadably engaged, is formed on the inner peripheral surface of the small-diameter hole.

In assembling and installing the vane rotor on the camshaft, the vane rotor can be fixed to the one axial end of the camshaft from the axial direction by tightening the head of the main valve-body part through the use of a predetermined jig, while screwing the male screw of the male screw-threaded structural part of the valve body into the female screw of small-diameter hole.

CITATION LIST

Patent Literature

Patent document 1: US 2013/0199469 A1

SUMMARY OF INVENTION

Technical Problem

However, in the control valve disclosed in the Patent document 1, the entire axial length of the valve timing control device tends to increase due to the layout of the main valve-body part and the male screw-threaded structural part greatly spaced apart from each other in the axial direction. As a result of this, there is a drawback that the layout flexibility inside of the engine room is limited, and thus there is a possibility of reduced mountability on the engine.

It is, therefore, in view of the previously-described technical drawbacks of the prior art control valves, an object of the invention to provide a control valve capable of reducing the axial length of a device as much as possible, thereby improving its mountability inside of the engine room.

Solution to Problem

In order to accomplish the aforementioned and other objects, according to the present invention, a control valve for a valve timing control device equipped with a driving rotary member adapted to receive a rotational force transmitted from a crankshaft and having an operating chamber formed therein, and a driven rotary member fixed to one axial end of a camshaft and rotatably housed in the driving rotary member so as to partition the operating chamber into a phase-advance working chamber and a phase-retard working chamber, and configured to relatively rotate to either a phase-advance side or a phase-retard side with respect to the driving rotary member by supply and discharge of working fluid for both of the working chambers, the control valve comprises a cylindrical valve body configured to axially fixedly connect the driven rotary member to the camshaft and a spool valve element axially slidably housed in the valve body and configured to perform switching between supply and discharge of the working fluid to and from each of the working chambers, wherein the valve body has a fixed part formed on an outer peripheral surface of the valve body nearer to the driven rotary member rather than near an axial distal end of the valve body, the fixed part being fixed in a fixing hole axially formed in the one axial end of the camshaft, and wherein the fixed part and the spool valve element are arranged to overlap with each other in an axial cross-section of the valve body.

Advantageous Effects of Invention

According to the present invention, the position of formation of the fixed part and the position of the spool valve element are arranged to overlap with each other in the axial cross-section, and thus it is possible to reduce the axial length of a device as much as possible. As a result of this, the mountability of the device inside of the engine room can be enhanced.

DESCRIPTION OF EMBODIMENTS

Figure 1:
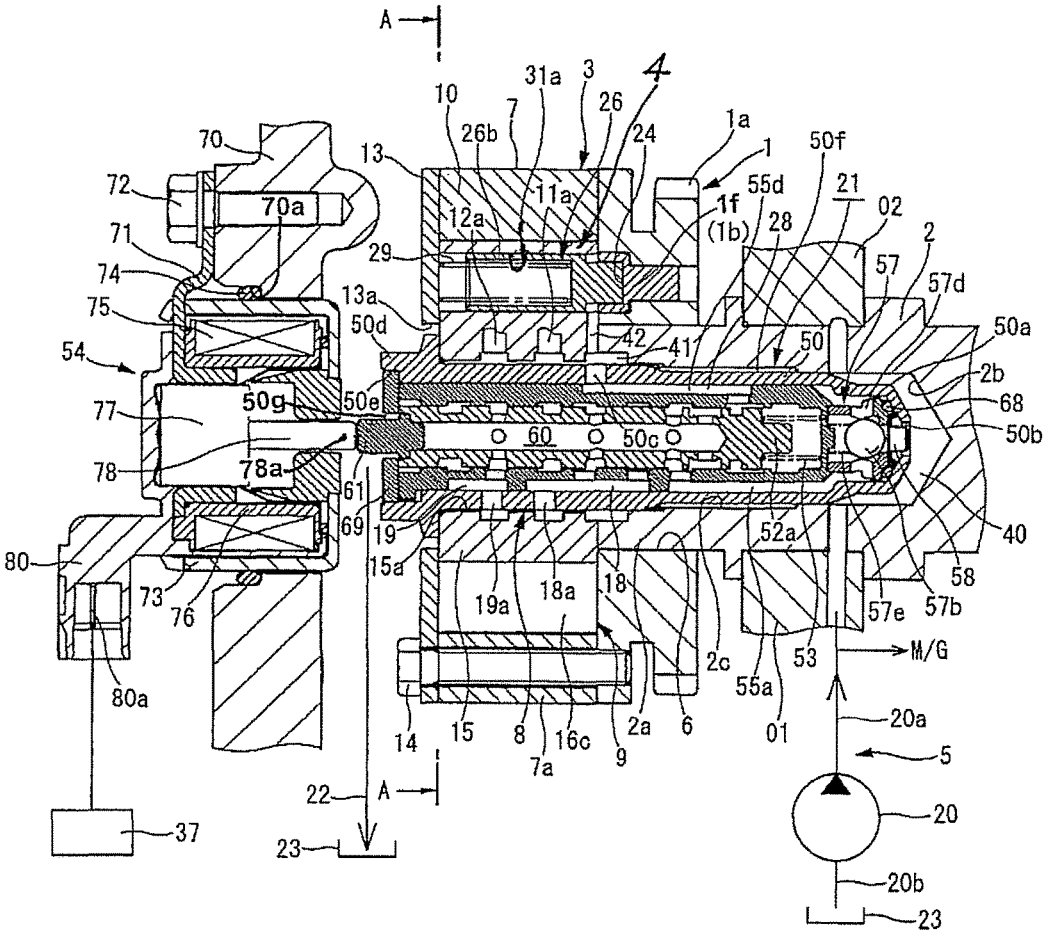
FIG. 1 is a longitudinally cross-sectional view illustrating the entire configuration of a valve timing control device to which a control valve of the invention is applied.

The embodiment of a control valve for a valve timing control device according to the invention is hereinafter described in detail with reference to the drawings.

As shown in FIGS. 1-4, the valve timing control device is equipped with a sprocket 1 serving as a driving rotary member rotationally driven by a crankshaft of an internal combustion engine via a timing chain, an intake-side camshaft 2 arranged in the longitudinal direction of the engine and configured to relatively rotate with respect to the sprocket 1, a phase conversion mechanism 3 interposed between the sprocket 1 and the camshaft 2 for changing a relative-rotation phase of the camshaft 2 to the sprocket 1, a position hold mechanism 4 serving as a lock mechanism for locking the phase conversion mechanism 3 at a prescribed position corresponding to an intermediate phase between a maximum advanced phase and a maximum retarded phase, and a hydraulic circuit 5 configured to operate the phase conversion mechanism 3 and the position hold mechanism 4 independently of each other.

Sprocket 1 is formed into a substantially thick-walled disk shape, and has a gear part 1*a* which is formed on the outer periphery and on which the timing sprocket is wound. The sprocket is configured as a rear cover that closes the rear end opening of a housing (described later). The sprocket is also formed with a central support hole 6 (a through hole) in which one end 2*a* of camshaft 2 is rotatably supported.

Camshaft 2 is rotatably supported on a cylinder head 01 through a plurality of cam bearings 02. A plurality of rotary cams are fixed onto and integrally formed on the outer peripheral surface of the camshaft for operating (opening) intake valves (not shown), which are engine valves, such that the rotary cams are axially placed. The camshaft has a bolt hole 2*b* axially formed in the one end 2*a* such that a cam bolt 8 (described later) is brought into screw-threaded engagement with the bolt hole. The bolt hole 2*b* is axially bored in the one end 2*a* from the forward end side, and formed as a stepped diameter-reduced part from the forward end side toward the inner bottom. Also, a female screw part 2*c* is formed in a substantially central area of the bolt hole 2*b* in the axial direction.

Figure 2:
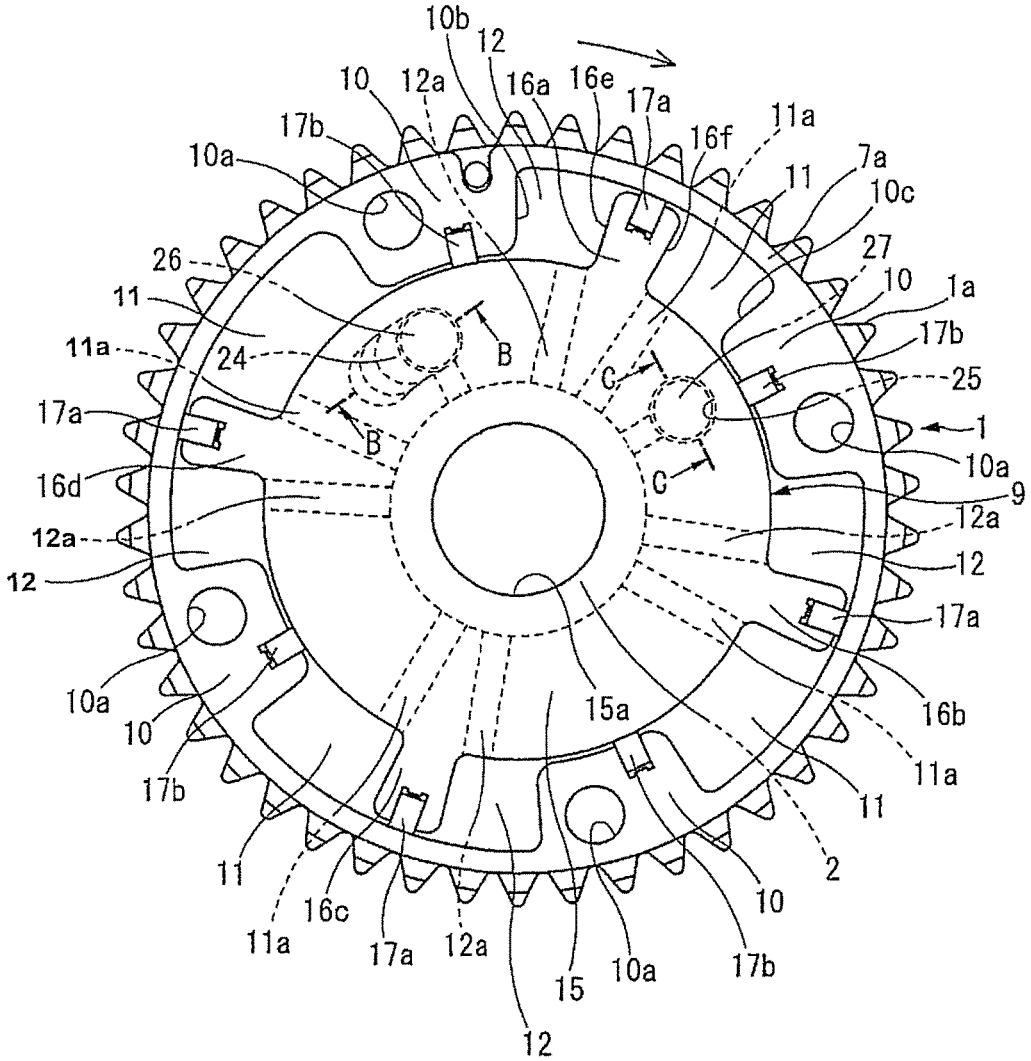
FIG. 2 is a cross-sectional view taken along the line A-A of FIG. 1 and showing a state where a vane rotor used in the embodiment has been held at a rotational position corresponding to an intermediate phase.

As shown in FIGS. 1 and 2, phase conversion mechanism 3 is provided with a housing 7 integrally formed with the sprocket 1 in the axial direction, a vane rotor 9 axially fixed onto the one end 2*a* of camshaft 2 by means of a valve body 50 (described later) functioning as the cam bolt and serving as a driven rotary member rotatably housed in the housing 7, and four phase-retard hydraulic chambers 11 and four phase-advance hydraulic chambers 12 respectively functioning as phase-retard working chambers and phase-advance working chambers, into which an operating chamber formed in the housing 7 is partitioned by four shoes 10, protruding from the inner peripheral surface of housing 7, and the vane rotor 9.

Housing 7 is constructed by a cylindrical housing main body 7*a* integrally formed of sintered alloy, a front cover 13 produced by pressing and provided for closing the front end opening of housing main body 7*a*, and the sprocket 1 that closes the rear end opening of the housing main body. The housing main body 7*a*, front cover 13, and sprocket 1 are fastened and fixed together with four bolts 14, which penetrate respective bolt insertion holes 10*a* of shoes 10. The front cover 13 is formed with a comparatively large-diameter central insertion hole 13*a* (a through hole). The inner peripheral surface of the circumference of insertion hole 13*a* is structured to seal each of hydraulic chambers 11, 12.

Vane rotor 9 is integrally formed of a metal material. The vane rotor is comprised of a rotor portion 15 fixedly connected to the one end 2*a* of camshaft 2 by means of the valve body 50, and four radially-protruding vanes 16*a*, 16*b*, 16*c*, and 16*d*, formed on the outer peripheral surface of rotor portion 15 and circumferentially spaced apart from each other by approximately 90 degrees.

Rotor portion 15 is formed into a comparatively large-diameter, substantially cylindrical shape. A central bolt insertion hole 15*a* is axially formed through the rotor portion 15 such that the central bolt insertion hole is configured to be continuous with the female screw part 2*c* of camshaft 2. The rear end face of rotor portion 15 is configured to be kept in abutted-engagement with the forward end face of the one end 2*a* of camshaft 2.

A protruding length of each of radially-protruding vanes 16*a*-16*d* is dimensioned to be comparatively short. Vanes 16*a*-16*d* are disposed in respective internal spaces defined by shoes 10. Vanes 16*a*-16*d* are configured to have almost the same circumferential width, and formed into a thick-walled plate. Vanes 16*a*-16*d* are equipped with seal members 17*a* attached to respective apexes of the vanes, while shoes 10 are equipped with seal members 17*b* attached to respective apexes of the shoes, for the purpose of sealing between the inner peripheral surface of housing main body 7*a* and the outer peripheral surface of rotor portion 15.

Figure 3:
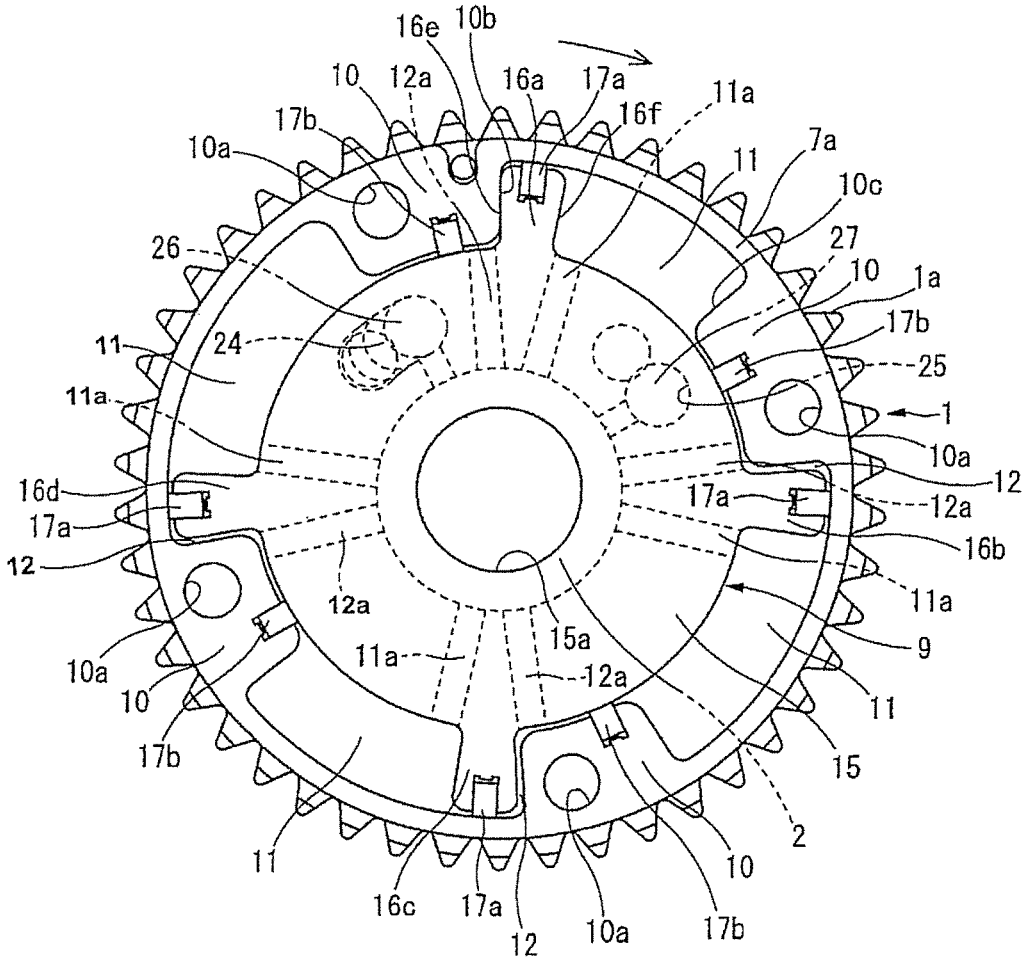
FIG. 3 is a cross-sectional view taken along the line A-A of FIG. 1 and showing a state where the vane rotor used in the embodiment has been rotated to a rotational position corresponding to a maximum retarded phase.
Figure 4:
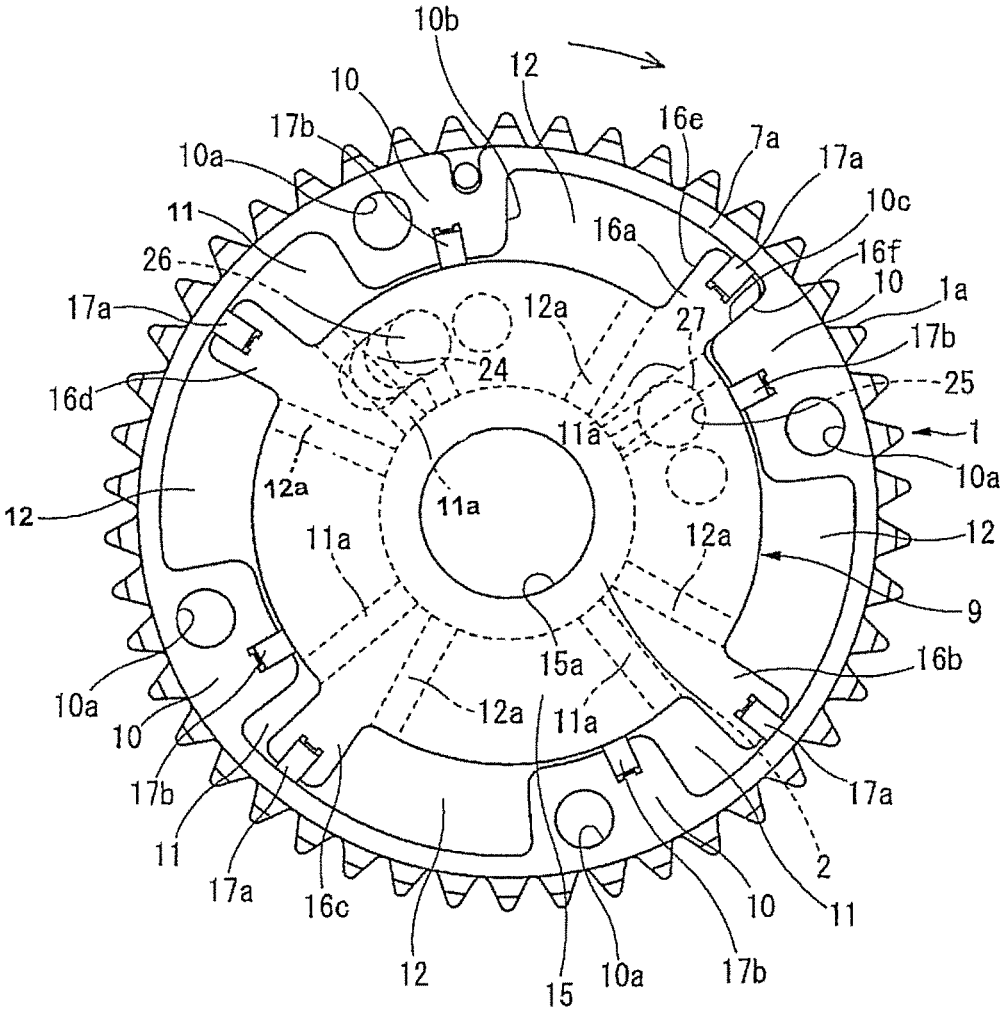
FIG. 4 is a cross-sectional view taken along the line A-A of FIG. 1 and showing a state where the vane rotor used in the embodiment has been rotated to a rotational position corresponding to a maximum advanced phase.

As shown in FIG. 3, vane rotor 9 is configured such that, when the vane rotor relatively rotates to a phase-retard side, a maximum phase-retarded rotational position of the vane rotor is restricted by abutted-engagement of one side face 16*e* of the first vane 16*a* with a protruded face 10*b* formed on an opposing side face of one of the shoes 10 facing the one side face 16*e*. In contrast, as shown in FIG. 4, vane rotor 9 is also configured such that, when the vane rotor relatively rotates to a phase-advance side, a maximum phase-advanced rotational position of the vane rotor is restricted by abutted-engagement of the other side face 16*f* of the first vane 16*a* with a protruded face 10*c* formed on an opposing side face of another of the shoes 10 facing the other side face 16*f*.

At this time, both side faces of each of three other vanes 16*b*-16*d* are kept in spaced, contact-free relationship with circumferentially opposing side faces of the associated shoes 10. Hence, the accuracy of abutment between the vane rotor 9 and the shoe 10 can be enhanced, and additionally the speed of hydraulic pressure supply to each of hydraulic chambers 11, 12 can be increased, and thus a responsiveness of normal-rotation/reverse-rotation of vane rotor 9 can be improved.

The previously-discussed phase-retard hydraulic chambers 11 and phase-advance hydraulic chambers 12 are defined and partitioned by both side faces (in the normal-rotational direction and in the reveres-rotational direction) of each of vanes 16*a*-16*d* and both side faces of each of shoes 10. Phase-retard hydraulic chambers 11 are configured to communicate with the hydraulic circuit 5 (described later) via respective first communication holes (respective first communication passages) 11*a* radially formed in the rotor portion 15. In a similar manner, phase-advance hydraulic chambers 12 are configured to communicate with the hydraulic circuit 5 via respective second communication holes (respective second communication passages) 12*a* radially formed in the rotor portion 15.

The previously-discussed position hold mechanism 4 is provided for holding the vane rotor 9 at an intermediate rotational phase position (i.e., the position shown in FIG. 2) between the maximum phase-retarded rotational position (i.e., the position shown in FIG. 3) and the maximum phase-advanced rotational position (i.e., the position shown in FIG. 4) with respect to the housing 7.

That is, as shown in FIGS. 1 and 5-10, the position hold mechanism is mainly comprised of lock hole structural parts 1*f*, 1*b*, a first lock hole 24, a second lock hole 25, a first lock pin 26, a second lock pin 27, and a lock passage 28. The lock hole structural parts are press-fitted into the inner peripheral section of sprocket 1 at their prescribed positions (see FIG. 1). The first lock hole 24 and the second lock hole 25 are formed in respective lock hole structural parts 1*f*, 1*b*. The first lock pin 26 and the second lock pin 27 are installed in the rotor portion 15 of vane rotor 9 and arranged at two circumferential places. The first lock pin 26 and the second lock pin 27 construct two lock members configured to move into and out of engagement with respective lock holes 24, 25. The lock passage 28 is provided for disengagement of the first lock pin 26 from the first lock hole 24 and for disengagement of the second lock pin 27 from the second lock hole 25.

As shown in FIGS. 2-4, the first lock hole 24 is formed as a circular-arc shaped long hole extending in the circumferential direction of sprocket 1. The first lock hole is formed in the inner face 1*c* of sprocket 1 and configured to be conformable to the intermediate position, which is displaced toward the phase-advance side with respect to the maximum phase-retarded rotational position of vane rotor 9. Also, the first lock hole 24 is formed as a three-stage stepped hole whose bottom face gradually lowers or deepens stepwise from the phase-retard side to the phase-advance side, and configured as a first lock guide groove.

That is, as shown in FIGS. 5 to 10, assuming that the inner face 1*c* of sprocket 1 is regarded as an uppermost level, the first lock guide groove is configured to gradually lower or deepen stepwise from the first bottom face 24*a* via the second bottom face 24*b* to the third bottom face 24*c*, in that order. Each of three inner faces arranged on the phase-retard side and vertically extending from respective bottom faces 24*a*-24*c*, is formed as an upstanding wall surface. Also, an inner face 24*d* arranged on the phase-advance side and vertically extending from the third bottom face 24*c*, is formed as an upstanding wall surface. Therefore, when the first lock pin 26 is brought into engagement with each of bottom faces 24*a*-24*c* in that order, the first lock pin 26 moves together with the rotor portion 15, and then the tip 26*a* of the first lock pin downwardly moves in the phase-advance direction from the inner face 1*c* of sprocket 1 through each of the bottom faces 24*a*-24*c*, in a stepwise manner. Movement of the first lock pin (the rotor portion) in the direction opposite to the phase-advance direction, that is, in the phase-retard direction, is restricted by means of each of the stepped faces. In this manner, each of the bottom faces 24*a*-24*c* is configured to function as a one-way clutch (a ratchet).

Figure 5:
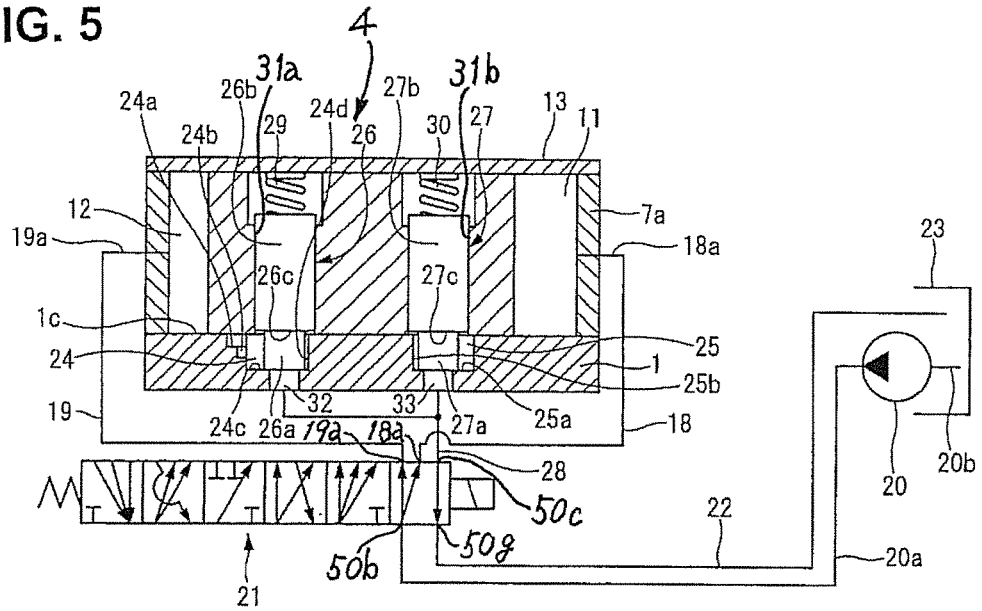
FIG. 5 is a cross-sectional view taken along the line B-B and the line C-C of FIG. 2 in combination and showing operation of each of lock pins in the embodiment.
Figure 6:
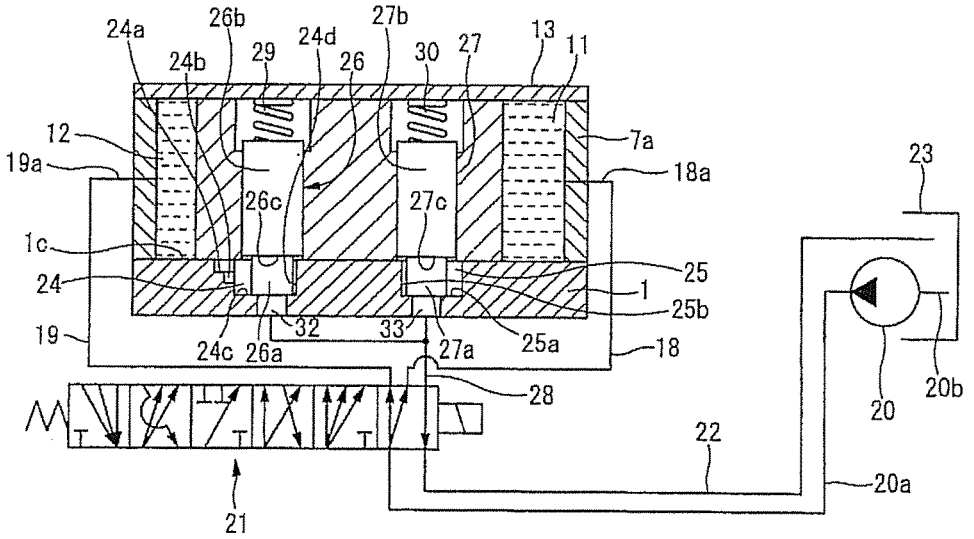
FIG. 6 is a cross-sectional view taken along the line B-B and the line C-C of FIG. 2 in combination and showing another operation of each of lock pins in the embodiment.

At the point of time when the edge of the outer circumference of the tip 26*a* of the first lock pin 26 has been brought into abutted-engagement with the upstanding inner face 24*d* vertically extending from the third bottom face 24*c*, a further movement of the first lock pin 26 in the phase-advance direction is restricted (see FIGS. 5-6).

As shown in FIGS. 2-4, the second lock hole 25 is formed into a circular shape having a diameter sufficiently greater than the outside diameter of the small-diameter tip 27*a* of the second lock pin 27, so as to permit a slight circumferential movement of the tip 27*a* of the second lock pin 27, which is brought into engagement with the second lock hole 25. Also, the second lock hole 25 is formed in the inner face 1*c* of sprocket 1 and configured to be conformable to the intermediate position, which is displaced toward the phase-advance side with respect to the maximum phase-retarded rotational position of vane rotor 9. Furthermore, the depth of the bottom face 25*a* of the second lock hole 25 is dimensioned to be almost the same depth as the third bottom face 24*c* of the first lock hole 25. Hence, when, owing to rotary motion of rotor portion 15 in the phase-advance direction, the tip 27*a* of the second lock pin 27 is brought into engagement with the second lock hole 25 and then brought into abutted-engagement with the bottom face 25*a*, the second lock pin 27 cooperates with the first lock pin 26 so as to restrict movement of the rotor portion in the direction opposite to the phase-advance direction, that is, movement of vane rotor 9 in the maximum phase-retard direction.

That is, at the point of time when the edge of the outer circumference of the tip 27*a* of the second lock pin 27 has been brought into abutted-engagement with the inner face 25*b* of the second lock hole 25 in the circumferential direction, the second lock pin 27 is configured to restrict movement of vane rotor 9 in the phase-retard direction.

By the way, regarding the relative-position relationship between the position of formation of the first lock hole 24 and the position of formation of the second lock hole 25, in a stage where the first lock pin 26 has been brought into engagement with the first bottom face 24*a* of the first lock hole 24, the tip 27*a* of the second lock pin 27 is kept in abutted-engagement with the inner face 1*c* of sprocket 1.

Thereafter, at the point of time when the first lock pin 26 has been brought into engagement with the second bottom face 24*b* of the first lock hole 24, the tip 27*a* of the second lock pin 27 is still kept in abutted-engagement with the inner face 1*c* of sprocket 1.

Thereafter, when the tip of the first lock pin 26 has been brought into engagement with the third bottom face 24*c*, and then brought into abutted-engagement with the upstanding inner face 24*d* with a further movement toward the phase-advance side, as shown in FIGS. 5-6, the tip 27*a* of the second lock pin 27 is brought into engagement with the second lock hole 25 and then brought into abutted-engagement with the inner face 25*b* of the second lock hole 25. Hence, the vane rotor 9 is sandwiched and locked by both the lock pins 26, 27.

In brief, as the vane rotor 9 relatively rotates from a prescribed phase-retarded position to a prescribed phase-advanced position, the first lock pin 26 is brought into abutted-engagement with each of the first bottom face 24*a*, the second bottom face 24*b*, and the third bottom face 24*c* in that order, in a stepwise manner. Thereafter, at the point of time when the first lock pin 26 has been brought into abutted-engagement with the upstanding inner face 24*d* with movement of the first lock pin 26 toward the phase-advance side while keeping sliding-contact with the third bottom face 24*c*, the second lock pin 27 is brought into engagement with the second lock hole 25 and then brought into abutted-engagement with the inner face 25*b*. By virtue of a three-stage ratchet action in total, vane rotor 9 relatively rotates in the phase-advance direction, while rotary motion of vane rotor 9 in the phase-retard direction is restricted. Finally, vane rotor 9 is held at the intermediate phase position between the maximum retarded phase and the maximum advanced phase.

As shown in FIGS. 1 and 5, the first lock pin 26 is slidably disposed in a first pin hole 31*a* formed in the rotor portion 15 as an axial through hole. The first lock pin is also formed with a stepped outside-diameter part, and integrally formed of the small-diameter tip 26*a*, a cylindrical-hollow large-diameter portion 26*b* positioned on the rear end side with respect to the tip 26*a*, and a stepped pressure-receiving surface 26*c* defined between the tip 26*a* and the large-diameter portion 26*b*. The distal end face of the tip 26*a* is formed as a flat end face configured to be abuttable in closely-contact relationship with each of the bottom faces 24*a*-24*c* of the first lock hole 24.

Also, the first lock pin 26 is forced or biased in the direction in which the first lock pin is brought into engagement with the first lock hole 24 by the spring force of a first spring 29, which is a biasing member elastically disposed between the bottom face of an axial recessed groove axially bored in the rear end of the large-diameter portion 26*b* and the inner face of the front cover 13.

As shown in FIGS. 5-10, the first lock pin 26 is also configured such that hydraulic pressure from a first unlocking pressure-receiving chamber 32 formed in the rotor portion 15 acts on the stepped pressure-receiving surface 26*c*. The hydraulic pressure causes a retreating movement of the first lock pin 26 out of engagement with the first lock hole 24 against the spring force of the first spring 29.

The second lock pin 27 is slidably disposed in a second pin hole 31*b* formed in the rotor portion 15 as an axial through hole. In a similar manner to the first lock pin 26, the second lock pin 27 is also formed with a stepped outside-diameter part, and integrally formed of the small-diameter tip 27*a*, a cylindrical-hollow large-diameter portion 27*b* positioned on the rear end side with respect to the tip 27*a*, and a stepped pressure-receiving surface 27*c* defined between the tip 27*a* and the large-diameter portion 27*b*. The distal end face of the tip 27*a* is formed as a flat end face configured to be abuttable in closely-contact relationship with the bottom face 25*a* of the second lock hole 25.

Also, the second lock pin 27 is forced in the direction in which the second lock pin is brought into engagement with the second lock hole 25 by the spring force of a second spring 30, which is a biasing member elastically disposed between the bottom face of an axial recessed groove axially bored in the rear end of the large-diameter portion 27*b* and the inner face of the front cover 13.

The second lock pin 27 is also configured such that hydraulic pressure from a second unlocking pressure-receiving chamber 33 formed in the rotor portion 15 acts on the stepped pressure-receiving surface 27*c*. The hydraulic pressure causes a retreating movement of the second lock pin 27 out of engagement with the second lock hole 25 against the spring force of the second spring 30.

By the way, the rear end sides of the first pin hole 31*a* and the second pin hole 31*b* have respective breathers (not shown) configured to be opened to the atmosphere, thereby ensuring smooth sliding movement of each of lock pins 26, 27.

As shown in FIGS. 1 and 5-10, the previously-discussed hydraulic circuit 5 includes a phase-retard passage 18, a phase-advance passage 19, the lock passage 28, an oil pump 20, and a single electromagnetic selector valve 21. Phase-retard passage 18 is provided for hydraulic-pressure supply-and-discharge for each of phase-retard hydraulic chambers 11 via the first communication passage 11*a*. Phase-advance hydraulic passage 19 is provided for hydraulic-pressure supply-and-discharge for each of phase-advance hydraulic chambers 12 via the second communication passage 12*a*. Lock passage 28 is provided for hydraulic-pressure supply-and-discharge for each of the first unlocking pressure-receiving chamber 32 and the second unlocking pressure-receiving chamber 33. Oil pump 20, which serves as a fluid-pressure supply source, is provided for selectively supplying working fluid (hydraulic pressure) to either one of phase-retard passage 18 and phase-advance passage 19, and also provided for supplying working fluid (hydraulic pressure) to the lock passage 28. The single electromagnetic selector valve 21, which is a directional control valve, is provided for switching among a variety of flow path configurations related to at least the phase-retard passage 18 and the phase-advance passage 19, and also provided for switching between working-fluid supply to the lock passage 28 and working-fluid discharge from the lock passage 28, depending on an engine operating condition.

One end of phase-retard passage 18 and one end of phase-advance passage 19 are connected to respective ports (described later) of the electromagnetic selector valve 21. The other end of phase-retard passage 18 is configured to communicate with each of phase-retard hydraulic chambers 11 through the first communication passage 11*a* as well as a phase-retard passage hole 18*a* serving as a phase-retard port formed in the electromagnetic selector valve 21. In a similar manner, the other end of phase-advance hydraulic passage 19 is configured to communicate with each of phase-advance hydraulic chambers 12 through the second communication passage 12*a* as well as a phase-advance passage hole 19*a* serving as a phase-advance port formed in the electromagnetic selector valve 21.

As shown in FIGS. 1 and 5, the lock passage 28 is axially formed in the electromagnetic selector valve 21. One end of lock passage 28 is configured to communicate with either a discharge passage 20*a* of oil pump 20 or a drain passage 22. The other end of lock passage 28 is configured to communicate with both the first unlocking pressure-receiving chamber 32 and the second unlocking pressure-receiving chamber 33 through an annular groove 41 and a radial oil hole 42 both formed at the joining sections of the one end 2*a* of the camshaft and the rotor portion 15.

For instance, in the shown embodiment, a typical rotary pump, such as a trochoid pump driven by an engine crankshaft, is used as the oil pump 20. By rotary motions of outer and inner rotors, working fluid sucked into the pump from within an oil pan 23 through a suction passage 20*b* is discharged through the discharge passage 20*a*. Part of the discharged working fluid is supplied through a main oil gallery M/G into sliding parts of the internal combustion engine. The remainder of the discharged working fluid is supplied to the side of electromagnetic selector valve 21. By the way, a filtration filter (not shown) is disposed downstream of the discharge passage 20*a*. Also, for the purpose of appropriate flow control, a fluid-flow control valve (not shown) is disposed downstream of the discharge passage 20 for returning excessive working fluid discharged from the discharge passage 20*a* through the drain passage 22 back to the oil pan 23.

As shown in FIGS. 1, 5, 11, and 14, electromagnetic selector valve 21 is a five-port, six-position, proportional control valve. The electromagnetic selector valve is mainly constructed by a bottomed cylindrical valve body 50, a bottomed cylindrical sleeve 51 axially inserted and installed in the valve body 50, a spool valve element 52 axially slidably disposed in the sleeve 51, a valve spring 53, which is a biasing member elastically disposed between the inner bottom surface of sleeve 51 and the tip of spool valve element 52 for biasing the spool valve element 52 leftward (viewing FIG. 1), and a solenoid mechanism (a solenoid part) 54, which is an actuator provided at an outermost end (one axial end) of the valve body 50 and configured to move the spool valve element 52 rightward (viewing FIG. 1) against the spring force of valve spring 53.

Valve body 50 is made of iron-based metal material, and configured as a cam bolt. The tip (the axial distal end) 50*a* of valve body 50 is formed into a substantially cone-shape in cross section. An introduction port 50*b* is axially formed through the center of the bottom wall of the tip 50*a*. Additionally, a plurality of ports are formed in the peripheral wall of valve body 50 as a plurality of radial through holes.

Furthermore, a male screw part 50*f* is formed on a part of the outer peripheral surface of valve body 50 near the tip 50*a* in a prescribed axial area. The male screw part 50*f* serves as a fixed part screwed into or threadably engaged with the female screw part 2*c* of camshaft 2.

The introduction port 50*b* is configured to communicate with an oil chamber 40 defined between the outer surface of the tip 50*a* and the inner bottom of the bolt hole 2*b* of camshaft 2. The oil hole 40 is connected to the downstream end of the discharge passage 20*a* of oil pump 20.

The phase-retard passage hole 18*a* and the phase-advance passage hole 19*a*, respectively serving as the phase-retard port communicating with each of the first communication passages 11*a* and the phase-advance port communicating with each of the second communication passages 12*a*, are radially formed through the peripheral wall of valve body 50 and located in the root of valve body 50 in the axial direction. Also, a lock port 50*c* is radially formed through the peripheral wall of valve body 50 and located in a substantially central position of valve body 50 such that the annular groove 41 and the lock passage 28 are communicated with each other through the lock port 50*c*.

The inner periphery of the rear end opening wall 50*d* of the root of valve body 50 (i.e., the head of the cam bolt) is formed with an annular retaining groove 50*e* into which a retaining member (a fixing member) 69 (described later) is press-fitted.

As shown in FIGS. 1 and 11-14, the outside diameter of the outer peripheral surface of sleeve 51 is formed slightly less than the inside diameter of the inner peripheral surface of valve body 50, thus providing a fluid-tight seal between these inner and outer peripheral surfaces. Also, a plurality of recessed passage grooves 55*a*-55*h* are formed in the outer peripheral surface of the peripheral wall of the sleeve and elongated along the axial direction. Additionally, a plurality of oil holes 56*a*-56*i* are formed as radial through holes at positions substantially conformable to respective passage grooves 55*a*-55*h*.

That is, as shown in FIGS. 1 and 11-13, sleeve 51 has the supply passage groove 55*a* communicating with the oil chamber 40, the phase-retard passage groove 55*b* formed at the position substantially conformable to the phase-retard passage hole 18*a*, the phase-advance passage groove 55*c* formed at the position substantially conformable to the phase-advance passage hole 19*a*, the lock passage groove 55*d* forming the lock passage 28, the first drain passage groove 55*e* appropriately communicated with the lock port 50*c*, the phase-retard passage hole 18*a*, and/or the phase-advance passage hole 19*a* for draining working fluid to the exterior, the supply passage groove 55*f* appropriately communicated with the lock port 50*c* for supplying working fluid discharged from the discharge passage 20*a* into each of pressure-receiving chambers 32-33, the second drain passage groove 55*g* appropriately communicated with the phase-retard passage hole 18*a* and/or the phase-advance passage hole 19*a* for draining working fluid in phase-retard hydraulic chambers 11 and/or phase-advance hydraulic chambers 12, and the supply passage groove 55*h* communicating with the oil chamber 40, these passage grooves being formed in the outer peripheral surface of the peripheral wall and configured along the axial direction from the top end of the sleeve.

Concretely, the sleeve has two similar oil holes 56*a*, 56*a* (see FIG. 13) formed as radial through holes at the positions substantially conformable to respective supply passage grooves 55*a*, 55*f*, oil hole 56*e* (see FIG. 13) formed as a radial through hole at the position substantially conformable to supply passage groove 55*h*, oil holes 56*b*, 56*d* formed as radial through holes at the position substantially conformable to the phase-retard passage groove 55*b*, oil hole 56*c* formed as a radial through hole at the position substantially conformable to the phase-advance passage groove 55*c*, oil holes 56*f*-56*h* formed as radial through holes at the position substantially conformable to the first drain passage groove 55*e*, and oil hole 56*i* formed as a radial through hole at the position substantially conformable to the lock passage groove 55*d*.

The top-end bottom wall 51*a* of sleeve 51 is integrally formed at the central position of its outer surface with a small-diameter cylindrical protruding portion 51*b*. Attached and fixed onto the bottom wall is a check valve 57, which is a one-way check valve for restricting a backflow of working fluid supplied from the discharge passage 20*a*.

Figure 14:
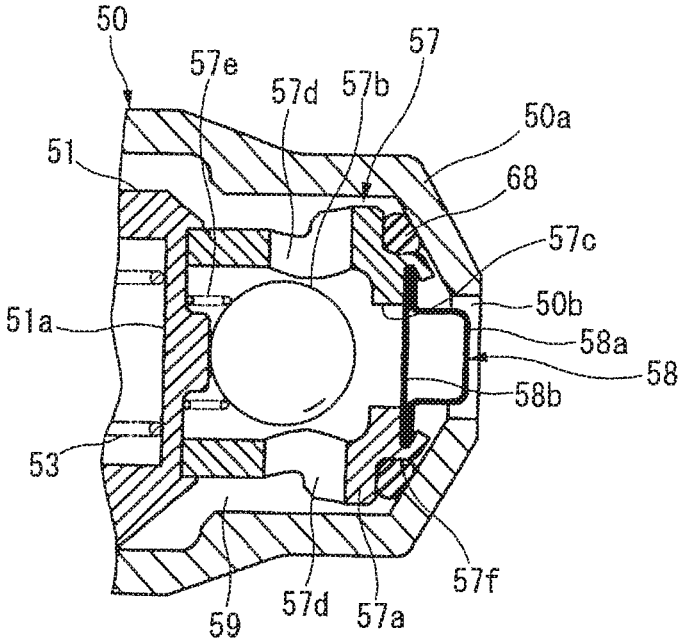
FIG. 14 is an enlarged cross-sectional view illustrating the essential part of a check valve used in the embodiment.

As best seen in FIG. 14, check valve 57 has a substantially cylindrical body part 57*a*, and a ball valve element 57*b* axially movably disposed in the body part 57*a*. Body part 57*a* is formed at its tip with an opening hole 57*c* configured to communicate with the introduction port 50*b* of valve body 50. A filter member 58 is attached to the opening hole 57*c*. Also, a plurality of oil holes 57*d* are radially formed through the peripheral wall of body part 57*a*. Each of oil holes 57*d* is configured to intercommunicate the interior of body part 57*a* with a passage part 59 defined between the inner peripheral surface of valve body 50 and the outer peripheral surface of sleeve 51.

Ball valve element 57*b* is seated on the edge of the innermost end of opening hole 57*c*, while being biased in the direction of closing the opening hole 57*c* by a coiled spring 57*e*. When hydraulic pressure exceeding a predetermined pressure value is applied at the introduction port 50*b*, ball valve element 57*b* is displaced backward against the spring force of coiled spring 57*e*, and then brought into abutted-engagement with the protruding portion 51*b*, thereby establishing fluid-communication between the opening hole 57*c* and each of oil holes 57*d*.

The outer periphery of the tip of body part 57*a* is formed with an annular retaining recess 57*f* for retaining a seal member 68 (described later), which is an elastic member.

Filter member 58 is formed into a substantially cup shape. The front end wall (the right-hand end wall) 58*a* is formed into a mesh shape, whereas the read-end fixing flange (the left-hand fixing flange) 58*b* is fixed onto the tip of body part 57*a* by caulking.

As shown in FIGS. 1, 11, and 15A-15B, the bottomed hollow internal space of spool valve element 52 is formed as an internal passage hole 60 through which working fluid flows. Both axial ends of internal passage hole 60 are closed by a cylindrical tip 52*a* and a cylindrical plug 61.

Also, spool valve element 52 is formed at both ends of the outer peripheral surface with two cylindrical guide parts 62*a*, 62*b*, for slidably guiding the spool valve element 52 along the inner peripheral surface of sleeve 51. Also, six lands 63*a*-63*f* are integrally formed on the outer peripheral surface between the two guide parts 62*a*-62*b* and arranged at prescribed intervals.

A communication hole 64*a* is formed on one side of the land 63*b* as a radial through hole for appropriately communicating the supply passage groove 55*a* with the internal passage hole 60. In a similar manner, a communication hole 64*b* is formed between the land 63*c* and the land 63*d* as a radial through hole for appropriately communicating the oil hole 56*b* (the phase-retard passage hole 18*a*) with the internal passage hole 60. Furthermore, a communication hole 64*c* is formed between the land 63*e* and the land 63*f* as a radial through hole for appropriately communicating the oil hole 56*c* (the phase-advance passage hole 19*a*) with the internal passage hole 60.

Moreover, a communication hole 64*d* is formed between the land 63*a* and the land 63*b* of spool valve element 52 as a through hole configured to communicate with the oil hole 56*i* that communicates with the lock passage groove 55*d*. Also, annular grooves are formed on their outer peripheral sides of respective communication holes 64*a*-64*d*.

One end of valve spring 53 is kept axially in elastic-contact with the inner bottom surface of the bottom wall 51*a* of sleeve 51, while the other end of valve spring 53 is kept axially in elastic-contact with the tip 52*a* of spool valve element 52, thereby biasing the spool valve element 52 toward the solenoid mechanism 54 (i.e., leftward, viewing FIG. 1).

An annular groove 65*a* is formed between the first guide part 62*a* and the land 63*a* of spool valve element 52, whereas an annular groove 65*b* is formed between the second guide part 62*b* and the land 63*f*. Another annular groove 65*c* is formed in the outer periphery between the communication hole 64*b* and the communication hole 64*c*. An oil chamber 66, through which working fluid flows, is defined between the tip 52*a* of spool valve element 52 and the top-end bottom wall 51*a* of sleeve 51 (that is, the accommodation chamber of valve spring 53).

The tip 52*a* of spool valve element 52 is arranged in the area of formation of the male screw part 50*f* of valve body 50. That is, the tip 52*a* of spool valve element 52 is arranged to overlap with the area of formation of the male screw part 50*f* of valve body 50 at any axial moving position of spool valve element 52 in the fore-and-aft direction.

As shown in FIGS. 1, 14, and 15, the axial position of sleeve 51 is positioned and fixed between the previously-mentioned retaining member (retainer) 69 and the previously-mentioned seal member 68, which is an elastic member, through the check valve 57 fixed to the top-end bottom wall 51*a*.

That is, seal member 68 is made of a synthetic rubber material and formed into an annular shape, and also serves to elastically position the axial position of sleeve 51 by abutting on the inner tapered surface of the cone-shaped tip 50*a* of valve body 50, while being retained in the retaining recess 57*f* formed at the tip of the body part 57*a* of check valve 57. Seal member 68 is also configured to prevent any flow of working fluid, which is flown from the introduction port 50*b* toward the filter member 58, toward the outer periphery of check valve 57.

The previously-discussed retaining member 69 is made of a disk-shaped metal plate and formed into an annular shape, and also has a central drain hole (a through hole) 69*a* formed through the center of the retaining member and configured to define a drain port 50*g* (see FIGS. 1 and 5) of valve body 50. The previously-discussed plug 61 is loosely fitted into the central drain hole 69*a* in a contact-free relationship therewith. The circumferential part of the retaining member is axially press-fitted into the retaining groove 50*e* of valve body 50. In this manner, by virtue of axial press-fit of the retaining member 69 in place, the retaining member cooperates with the seal member 68 such that the sleeve 51 is positioned and fixed with respect to the valve body 50, while being axially forced by the elastic force of seal member 68.

Figure 11:
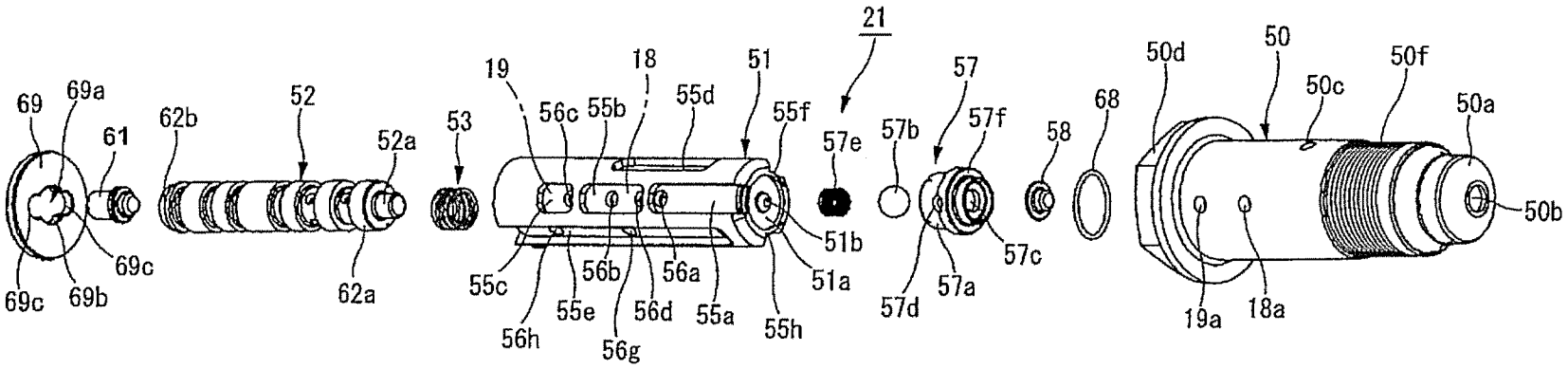
FIG. 11 is a perspective view illustrating part of an electromagnetic selector valve in the embodiment.
Figure 12:
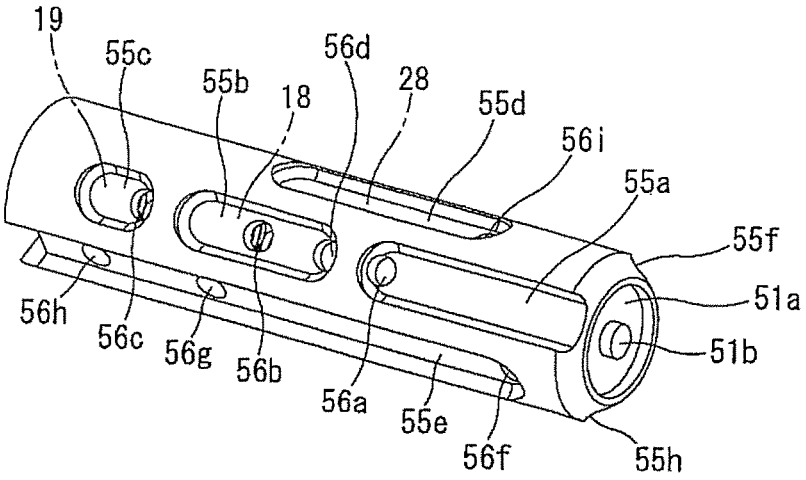
FIG. 12 is a perspective view illustrating a sleeve used in the embodiment.
Figure 13:
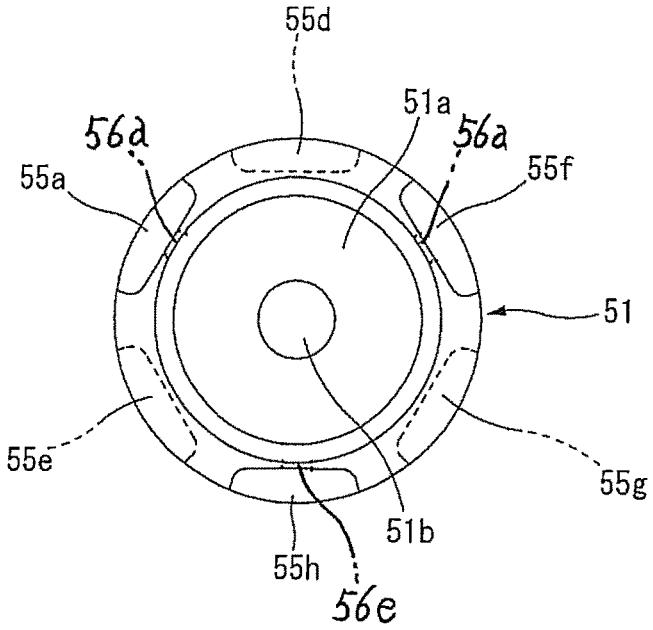
FIG. 13 is a front view illustrating the sleeve.

As shown in FIG. 11, the previously-noted drain hole 69*a* is formed into a long hole shape diametrically elongated from its central circular hole 69*b*. For instance, as shown in FIG. 15, even when the rear end face of spool valve element 52 has been brought into abutted-engagement with the inner surface of retaining member 69, diametrically-opposed circular-arc shaped openings 69*c*, 69*c* are permanently kept in their open states.

As shown in FIG. 1, solenoid mechanism 54 is mainly constructed by a solenoid casing 73 fixed to a chain cover 70 through a bracket 71 with a bolt 72, an electromagnetic coil 75, which is installed in the solenoid casing 73 and to which a control current from an electronic controller 37 is outputted, a bottomed cylindrical stationary yoke 76 fixed on the inner peripheral side of electromagnetic coil 75, a movable plunger 77 axially slidably installed in the stationary yoke 76, and a driving rod 78 formed integral with the top end of movable plunger 77. The tip 78*a* of driving rod 78 is configured to force the plug 61 of spool valve element 52 against the spring force of valve spring 53 rightward (viewing FIG. 1).

Solenoid casing 73 is retained in a retaining hole 70*a* of chain cover 70 by means of a seal ring 74. A synthetic-resin connector 80 is attached to the rear end of solenoid casing 73, and configured to have a terminal 80*a* electrically connected to the electronic controller 37.

Also, the axial length of solenoid casing 73 is formed shorter than its radial length, that is, an outside diameter, and configured as a so-called flat casing, which is flat in cross section.

As shown in FIGS. 15-20, solenoid mechanism 54 is configured to move the spool valve element 52 at either one of the six axial positions in the fore-and-aft direction, depending on a relative pressing force (balancing opposing pressing forces) created by the control current of electronic controller 37 and the spring force of valve spring 53, thereby ensuring an unique flow path configuration for each unique spool position, based on an appropriate combination of oil holes 56*a*-56*i* of sleeve 51 and communication holes 64*a*-64*d* of the spool valve element, based on each unique spool position.

Electronic controller 37 receives input informational signals from various sensors, that is, a not-shown crank angle sensor (an engine revolution speed sensor), an air flowmeter, an engine coolant temperature sensor (an engine temperature sensor), a throttle opening sensor, a cam angle sensor, and the like. The cam angle sensor is provided for detecting latest up-to-date information about a relative-rotation phase of camshaft 2. The controller is configured to detect the current engine operating condition based on the input informational signals from the previously-discussed sensors. Also, the controller is configured to generate a control pulse current, based on the detected current engine operating condition, to the electromagnetic coil 75 of electromagnetic selector valve 21, for controlling the axial moving position of spool valve element 52, thus achieving selective switching among the ports depending on the controlled axial position of the spool valve element.

Position Control of Spool Valve Element

Figure 20A:
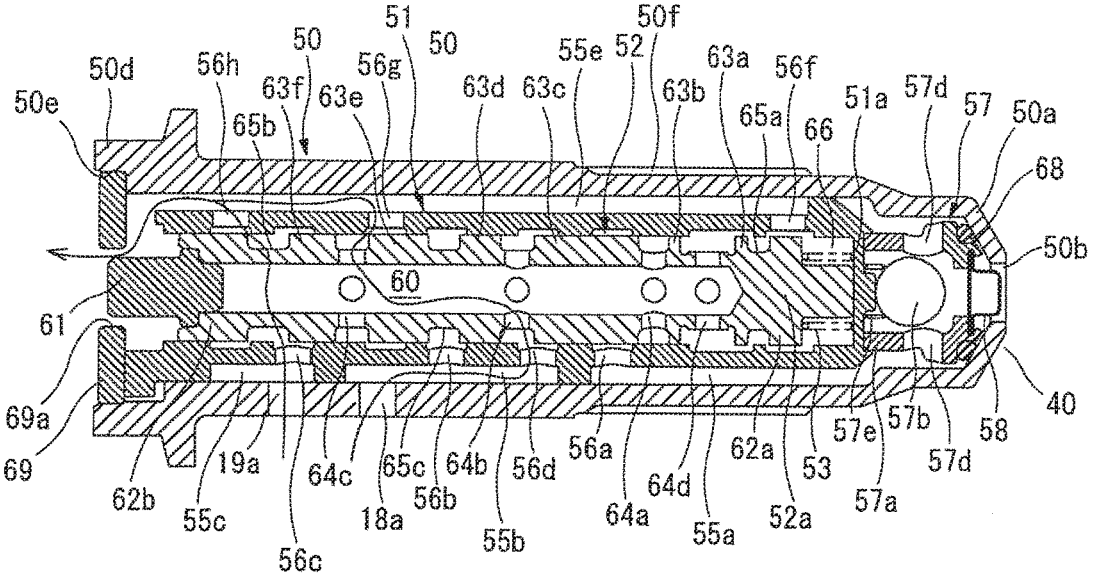
FIGS. 20A-20B are two places of longitudinal cross-sectional views illustrating a fifth position of the spool valve element.
Figure 20B:
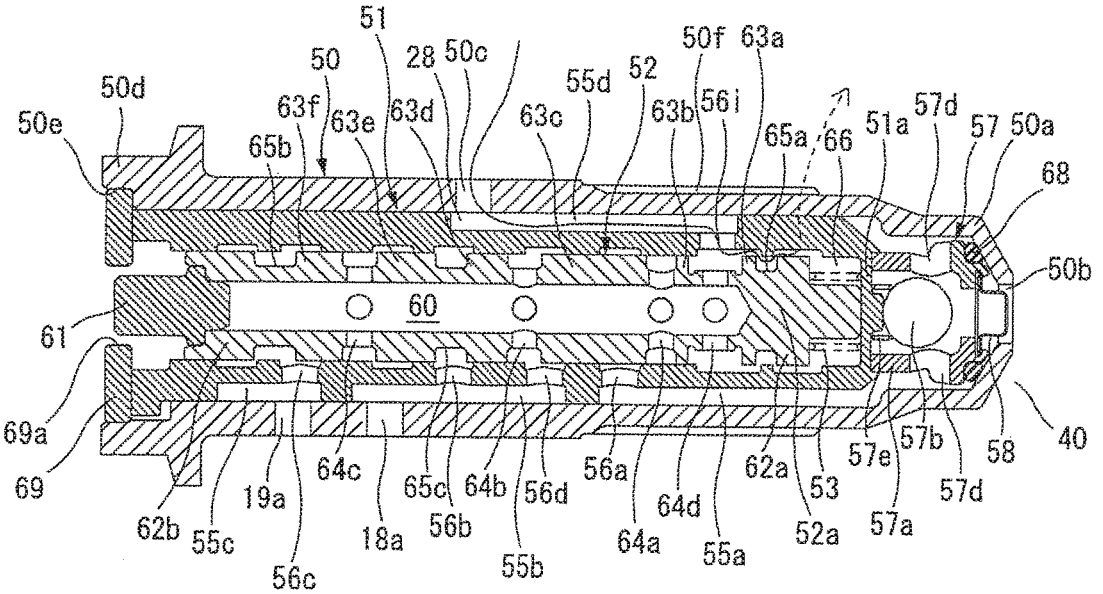
Figure 21:
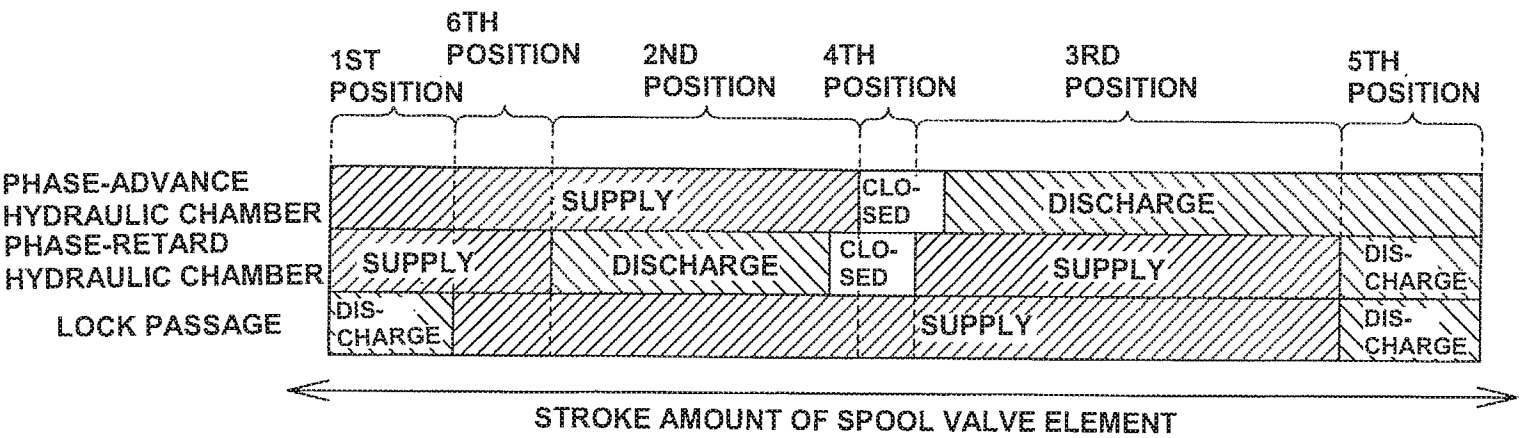
FIG. 21 is a table showing the relationship among the stroke amount of a spool valve element (i.e., a spool position), working-fluid supply to each of hydraulic chambers and a lock passage, and working-fluid discharge from each of the hydraulic chambers and the lock passage.

The position control of spool valve element 52 is hereinafter explained more concretely by reference to FIGS. 15A-15B to 20A-20B, as well as the table of FIG. 21 showing the relationship among the stroke amount of spool valve element 52, working-fluid supply to each of hydraulic chambers 11, 12, and each of unlocking pressure-receiving chambers 32, 33 (i.e., lock passage 28), and working-fluid discharge from each of the hydraulic chambers and each of the unlocking pressure-receiving chambers.

Figure 15A:
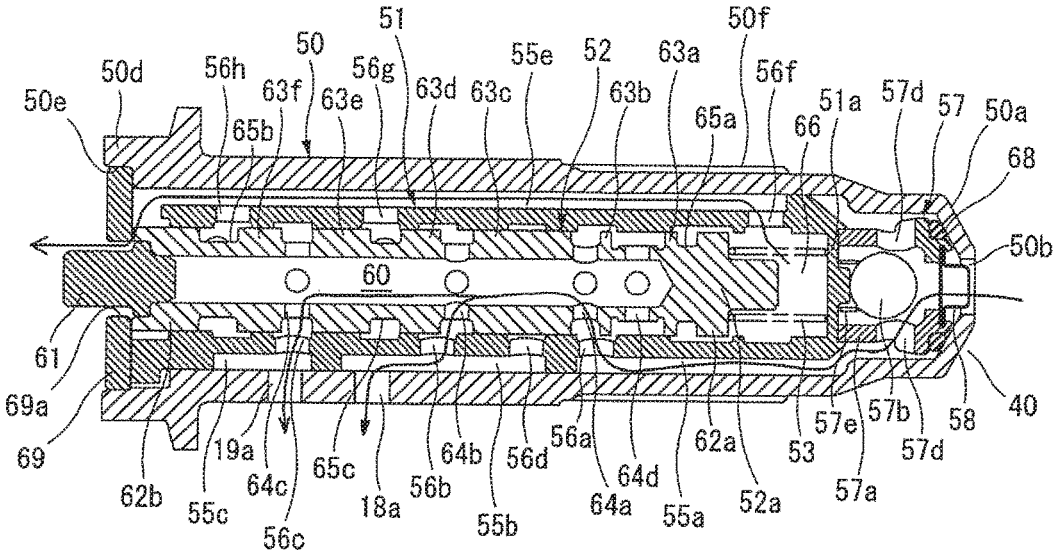
FIGS. 15A-15B are two places (two axial planes) of longitudinal cross-sectional views illustrating a first position of a spool valve element of the electromagnetic selector valve in the embodiment.
Figure 15B:
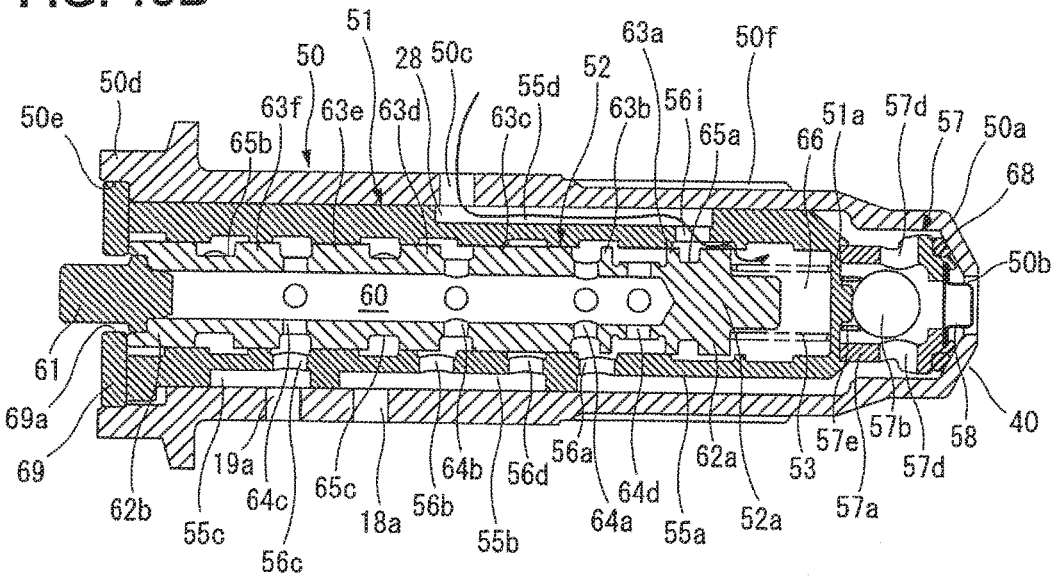

When, solenoid mechanism 54 is de-energized responsively to an OFF (de-energizing) signal) from electronic controller 37, that is, when, as shown in FIGS. 15A-15B, spool valve element 52 is positioned at its leftmost position (i.e., the first position) by the spring force of valve spring 53, fluid-communication between oil hole 56*a* and communication hole 64*a* is established, fluid-communication between communication hole 64*b* and oil hole 56*b* is established, and fluid-communication between communication hole 64*c* and oil hole 56*c* is established.

Therefore, as indicated by the arrows, working fluid, which has been supplied and introduced from the discharge passage 20*a* of oil pump 20 through the introduction port 50*b* and then passed and filtered through the filter member 58, pushes the ball valve element 57*b* in the open position. Thus, the working fluid is supplied through the oil holes 57*d*, the supply passage groove 55*a*, the oil hole 56*a*, the communication hole 64*a*, the internal passage hole 60, the communication holes 64*b*, 64*c*, the oil holes 56*b*, 56*c*, the phase-retard passage hole 18*a*, and the phase-advance passage hole 19*a* to each of phase-retard hydraulic chambers 11 and each of phase-advance hydraulic chambers 12. At the same time, as shown in FIG. 15B, the working fluid, having been supplied to each of pressure-receiving chambers 32, 33, flows through the oil hole 42 into the lock port 50*c* and the lock passage groove 55*d*, and temporarily flows through the oil hole 56*i* into the oil chamber 66. Thereafter, as shown in FIG. 15A, the working fluid further flows through the different oil hole 56*f* into the drain passage groove 55*e*, and then the working fluid is drained through the both-side openings 69*c*, 69*c* of the drain hole 69*a* of retaining member 69 and the drain passage 22 into the oil pan 23.

Figure 16A:
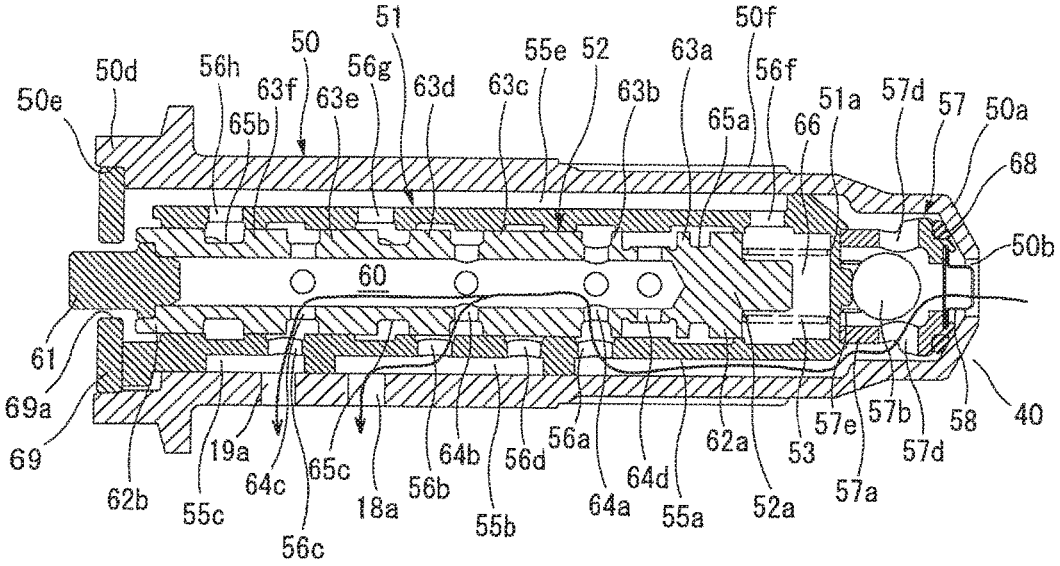
FIGS. 16A-16B are two places of longitudinal cross-sectional views illustrating a sixth position of the spool valve element.
Figure 16B:
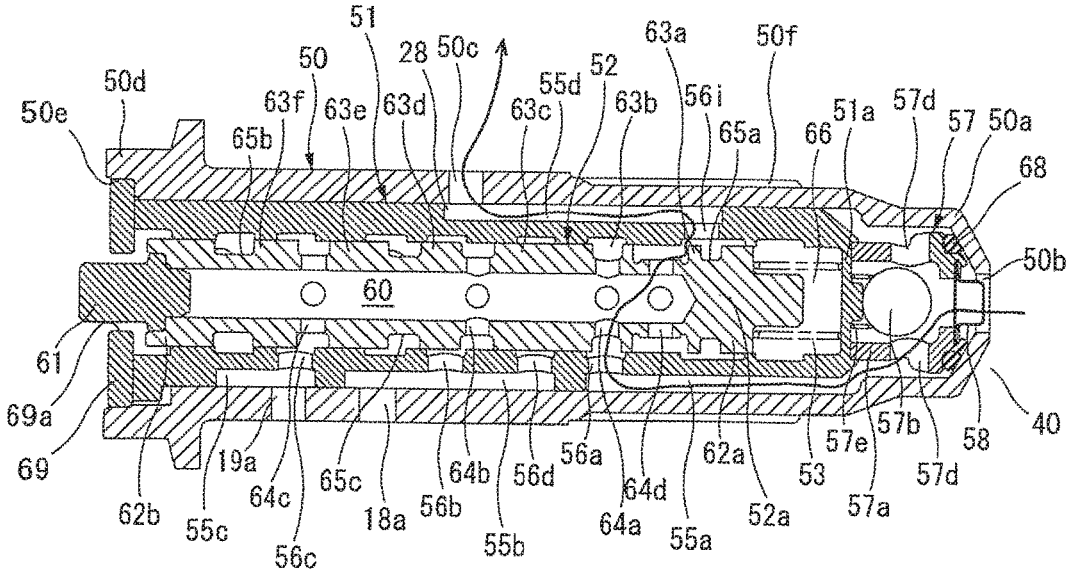

Next, as shown in FIGS. 16A-16B, when spool valve element 52 has been slightly displaced rightward (i.e., the sixth position) against the spring force of valve spring 53 by energizing the solenoid mechanism 54, in the same manner as FIG. 15A, as indicated by the arrows, a state where working fluid, which has been supplied from the discharge passage 20*a*, has been delivered through the plurality of oil holes 57*d*, the supply passage groove 55*a*, the oil hole 56*a*, the communication hole 64*a*, the internal passage hole 60, the communication holes 64*b*, 64*c*, the oil holes 56*b*, 56*c*, the phase-retard passage hole 18*a*, and the phase-advance passage hole 19*a* to each of phase-retard hydraulic chambers 11 and each of phase-advance hydraulic chambers 12, is continued.

On the other hand, as shown in FIG. 16B, part of working fluid, which has flown into the communication hole 64*a*, is supplied through the internal passage hole 60, the communication hole 64*d*, the oil hole 56*i*, and the lock passage groove 55*d*, and then supplied via the lock port 50*c*, and the oil hole 42 to each of pressure-receiving chambers 32, 33.

Figure 17A:
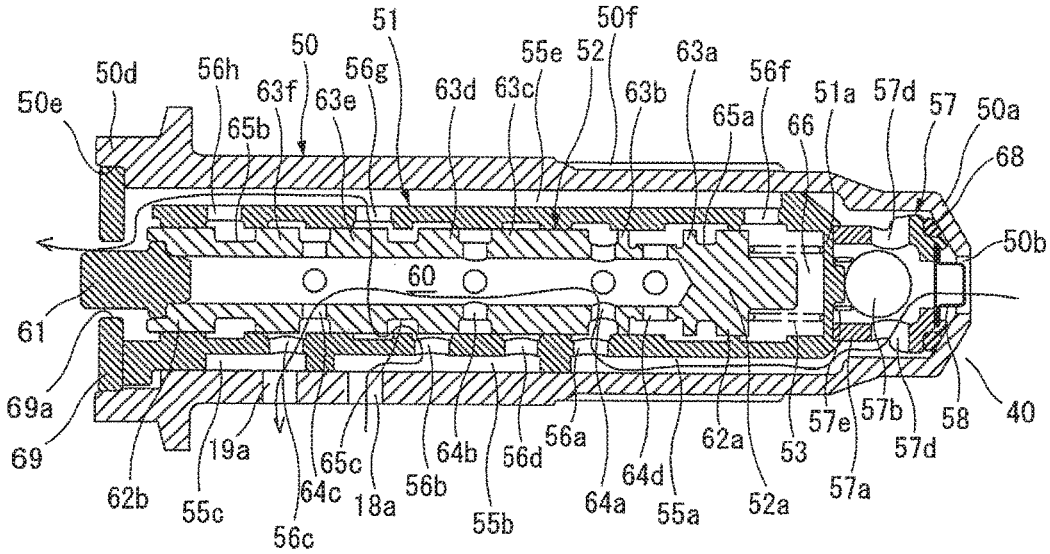
FIGS. 17A-17B are two places of longitudinal cross-sectional views illustrating a second position of the spool valve element.
Figure 17B:
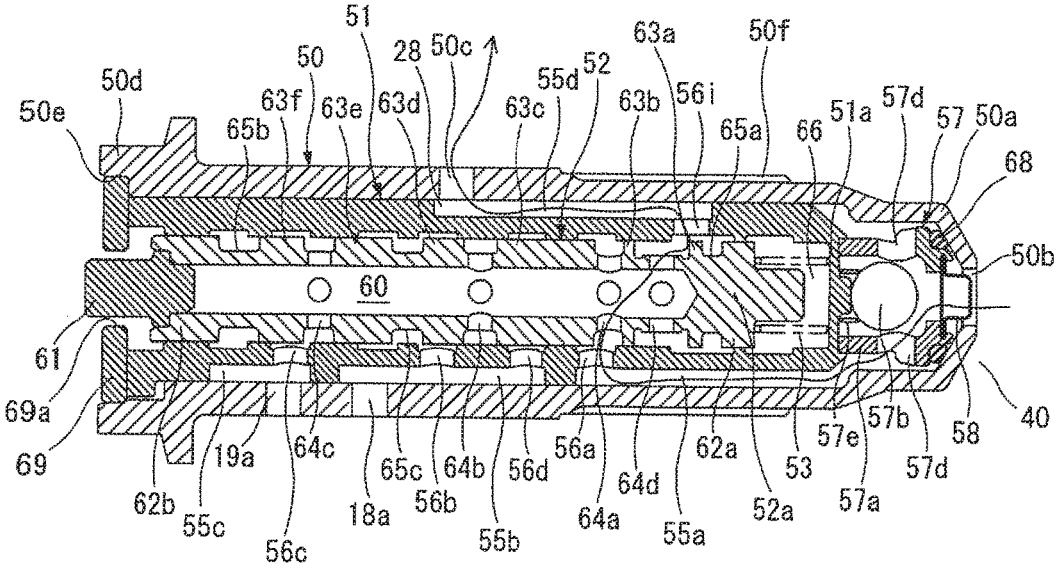

As shown in FIGS. 17A-17B, when spool valve element 52 has been further displaced slightly rightward (i.e., the second position) with a greater energization amount to the solenoid mechanism 54, as indicated by the arrows in FIG. 17A, fluid-communication between oil hole 56*b* and annular groove 65*c* is established, and fluid-communication among annular groove 65*c*, oil hole 56*g*, and drain passage groove 55*e* is established. Also, the fluid-communication state between communication hole 64*c* and oil hole 56*c* is still maintained. Thus, working fluid in each of phase-retard hydraulic chambers 11 is drained, and a state where working fluid has been supplied to each of phase-advance hydraulic chambers 12 is maintained.

On the other hand, as shown in FIG. 17B, the fluid-communication state between oil hole 56*a* and communication hole 64*a* is maintained, while the fluid-communication state among communication hole 64*d*, oil hole 56*i*, and lock passage groove 55*d* is maintained. Thus, the unlocked states of lock pins 26, 27 are continued by working-fluid supply to each of pressure-receiving chambers 32, 33.

Figure 18A:
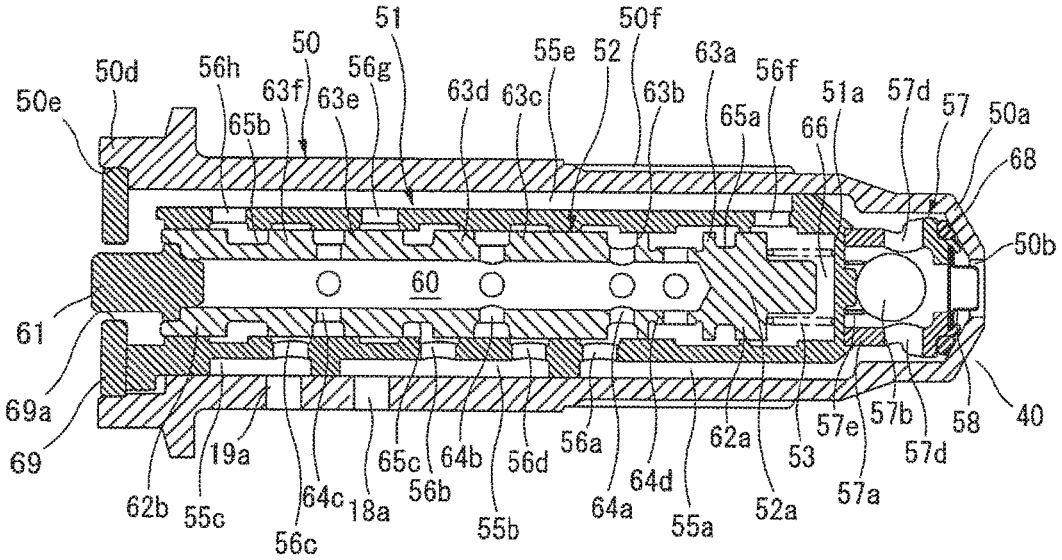
FIGS. 18A-18B are two places of longitudinal cross-sectional views illustrating a fourth position of the spool valve element.
Figure 18B:
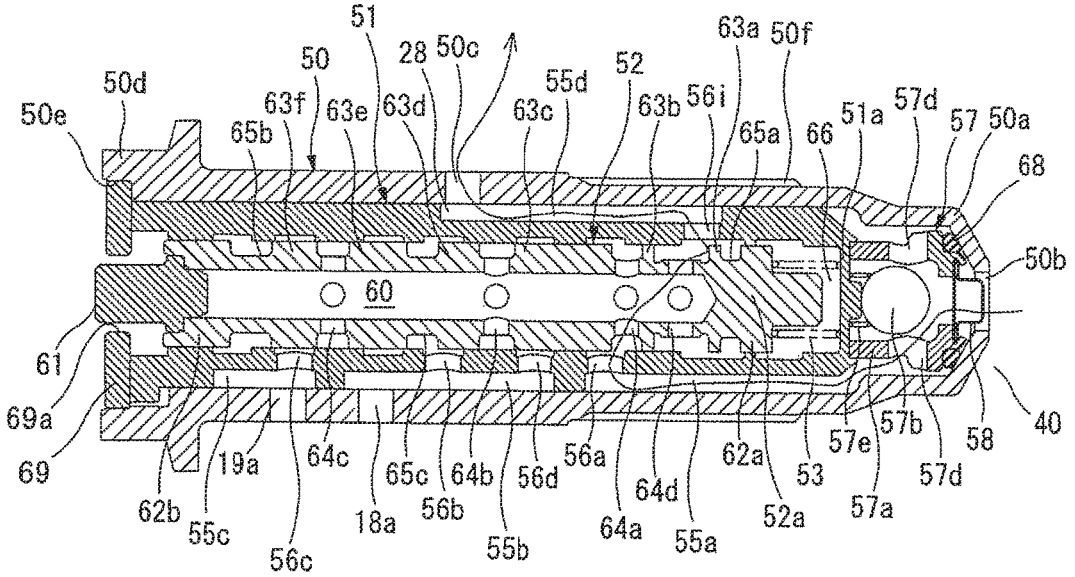

As shown in FIGS. 18A-18B, when spool valve element 52 has been further displaced slightly rightward (i.e., the fourth position), as seen FIG. 18A, oil hole 64*a* is opened, whereas communication holes 64*b*, 64*c* are closed by the inner peripheral surface of sleeve 51. Therefore, working-fluid supply from the discharge passage 20*a* to each of phase-retard hydraulic chambers 11 and working-fluid supply from the discharge passage to each of phase-advance hydraulic chambers 12 are stopped.

On the other hand, as shown in FIG. 18B, the fluid-communication state between oil hole 56*a* and communication hole 64*a* is maintained, while the fluid-communication state among communication hole 64*d*, oil hole 56*i*, and lock passage groove 55*d* is maintained. Hence, working fluid flows as indicated by the arrow in FIG. 18B, and thus hydraulic pressure is supplied to each of pressure-receiving chambers 32, 33, and as a result the unlocked states of lock pins 26, 27 are continued.

Figure 19A:
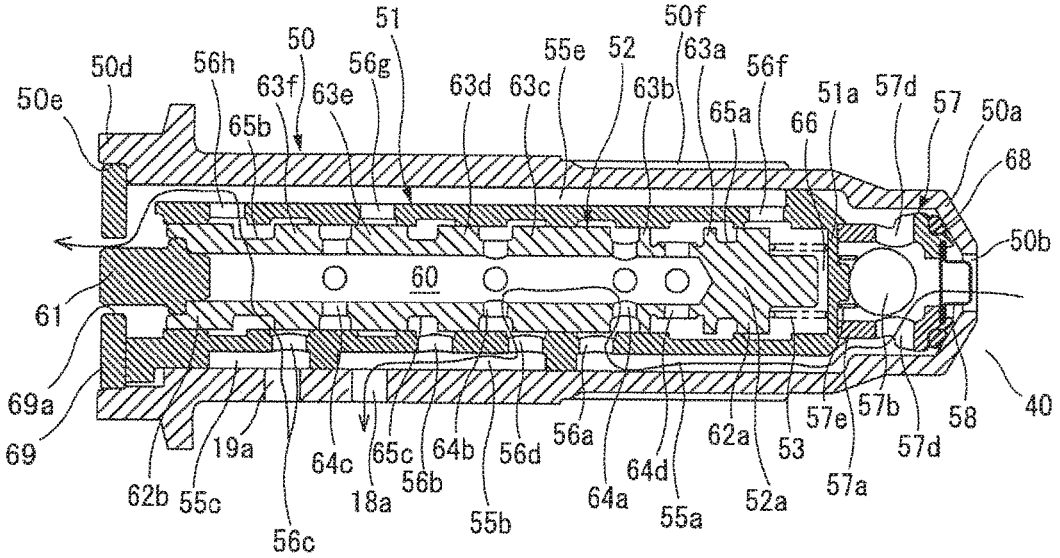
FIGS. 19A-19B are two places of longitudinal cross-sectional views illustrating a third position of the spool valve element.
Figure 19B:
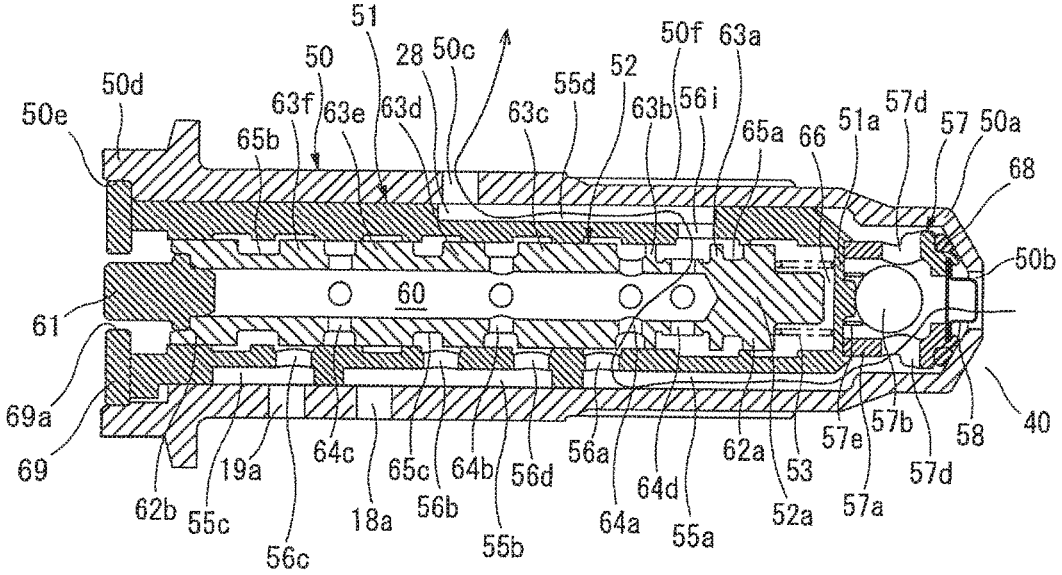

As shown in FIGS. 19A-19B, when spool valve element 52 has been further displaced slightly rightward (i.e., the third position) by a control current outputted from the electronic controller 37, fluid-communication between communication hole 64*d* and oil hole 56*d* is established, while fluid-communication among oil hole 56*h*, annular groove 65*b*, and oil hole 56*c* is established. Hence, working fluid is supplied from the discharge passage 20*a* to each of phase-retard hydraulic chambers 11, but working fluid in each of phase-advance hydraulic chambers 12 is drained to the exterior as indicated by the arrow.

On the other hand, as shown in FIG. 19B, the fluid-communication state between oil hole 56*a* and communication hole 64*a* is maintained, while the fluid-communication state among communication hole 64*d*, oil hole 56*i*, and lock passage groove 55*d* is maintained. Hence, working fluid flows as indicated by the arrow in FIG. 19B, and thus hydraulic pressure is supplied to each of pressure-receiving chambers 32, 33, and as a result the unlocked states of lock pins 26, 27 are continued.

Furthermore, as shown in FIGS. 20A-20B, when spool valve element 52 has been displaced to its rightmost position (i.e., the fifth position) with a maximum energization amount to the electronic solenoid 54, the fluid-communication state where oil hole 56*h*, annular groove 65*b*, and oil hole 56*c* are communicated with each other is maintained, and thus working fluid in each of phase-advance hydraulic chambers 12 is drained. At the same time, fluid-communication between oil hole 56*d* and communication hole 64*b* is established, while fluid-communication between communication hole 64*c* and oil hole 56*g* is established, and as a result working fluid in each of phase-retard hydraulic chambers 11 is also drained to the exterior.

On the other hand, as shown in FIG. 20B, fluid-communication among the annular groove formed on the outer peripheral side of communication hole 64*d*, the oil hole 56*i*, and the annular groove 65*a* is established. Hence, working fluid in each of pressure-receiving chambers 32, 33 temporarily flows into the oil chamber 66 as indicated by the arrow, and thereafter, as shown in FIG. 20A, the working fluid further flows from the oil chamber 66 through the oil hole 56*f* and then passes through the drain passage groove 55*e*. Then, the working fluid is drained through the drain hole 69*a* to the exterior, together with the working fluid from each of phase-retard hydraulic chambers 11 and the working fluid from each of phase-advance hydraulic chambers 12.

In this manner, selective switching among the ports is performed by changing the axial moving position of spool valve element 52 depending on the engine operating condition, and therefore the relative rotation angle (the relative-rotation phase) of vane rotor 9 to timing sprocket 1 is changed, and simultaneously selective switching between the locked (engagement) state of lock pins 26, 27 with lock holes 24, 25 and the unlocked (disengagement) state of the lock pins from the lock holes is performed so as to permit or restrict free rotation of the vane rotor 9.

Operation of Embodiment

Concrete operation of the valve timing control device of the embodiment is hereunder explained.

First, when the engine has been stopped by turning the ignition switch OFF after normal vehicle driving, energization to solenoid mechanism 54 is interrupted. Thus, spool valve element 52 moves to the leftmost position (i.e., the first position) shown in FIGS. 15A-15B by the spring force of valve spring 53. Hence, in accordance with the previously-discussed operation, phase-retard passage 18 and phase-advance passage 19 are both communicated with the discharge passage 20*a*, and simultaneously lock passage 28 and drain passage 22 are communicated with each other.

Driving of oil pump 20 is also stopped, and thus working-fluid supply to each of hydraulic chambers 11, 12 and working-fluid supply to each of pressure-receiving chambers 32, 33 are stopped.

During the idling rotation before the engine has stopped running, assuming that the ignition switch is tuned OFF under a state where hydraulic pressure has been supplied to each of phase-retard hydraulic chambers 11 and thus the vane rotor 9 has been positioned at a phase-retarded rotational position, positive and negative alternating torque, acting on the camshaft 2, takes place immediately before the engine has been brought into the stopped state. Immediately when, in particular due to a negative torque, vane rotor 9 rotates from the phase-retard side to the phase-advance side and then reaches the intermediate phase position, advancing-movements of the first lock pin 26 and the second lock pin 27 occur by the spring forces of respective springs 29, 30, and as a result the tips 26*a*, 27*a* are brought into engagement with the first lock hole 24 and the second lock hole 25, respectively. As a result of this, vane rotor 9 is held the intermediate phase position (between the maximum advanced phase and the maximum retarded phase) shown in FIG. 2.

That is, vane rotor 9 slightly rotates to the phase-advance side due to a negative alternating torque acting on the camshaft 2, and thus the tip 26*a* of the first lock pin 26 is brought into abutted-engagement with the first bottom face 24*a* of the first lock hole 24. At this time, assuming that a positive alternating torque acts on the vane rotor 9, the vane rotor tends to rotate toward the phase-retard side, but this rotation toward the phase-retard side is restricted by abutment of the edge of the outer circumference of the tip 26*a* of the first lock pin 26 with the upstanding stepped inner face of the first bottom face 24*a*.

Thereafter, when, due to another negative torque, vane rotor 9 further rotates to the phase-advance side, the first lock pin 26 is brought into abutted-engagement with the second bottom face 24*b* and the third bottom face, in that order, while moving downward in a stepwise manner. After this, the first lock pin further moves on the third bottom face 24*c* in the phase-advance direction, while receiving the ratchet action. At the same time, the tip 27*a* of the second lock pin 27 is brought into abutted-engagement with the bottom face 25*a* of the second lock hole 25, and finally kept in abutted-engagement with the inner face 25*b* of the second lock hole in the circumferential direction.

That is, at this time, as shown in FIG. 5, the edge of the outer circumference of the tip 26*a* of the first lock pin 26 is kept in abutted-engagement with the upstanding inner face 24*d* vertically extending from the third bottom face 24*c* and arranged on the phase-advance direction (on the side of phase-retard hydraulic chamber 11), while the edge of the outer circumference of the tip 27*a* of the second lock pin 27 is kept in abutted-engagement with the inner face 25*b* arranged on the side of phase-advance hydraulic chamber 12, and whereby these two lock pins can be stably held, respectively.

Thereafter, when the ignition switch is turned ON for starting the engine, oil pump 20 is driven owing to an initial explosion (a start of cranking) immediately after having turned the ignition switch ON. Thus, as shown in FIG. 15A, its discharge pressure is supplied through the phase-retard passage 18 (the phase-retard passage groove 55*b*) and the phase-advance passage 19 (the phase-advance passage groove 55*c*), and the phase-retard passage hole 18*a* and the phase-advance passage hole 19*a* to each of phase-retard hydraulic chambers 11 and each of phase-advance hydraulic chambers 12. On the other hand, lock passage 28 is kept in a fluid-communication relationship with the drain passage 22. Hence, as shown in FIG. 6, lock pins 26, 27 are kept in engagement with respective lock holes 24, 25 by the spring forces of springs 29, 30.

Also, electromagnetic selector valve 21 is controlled by the electronic controller 37, based on the input informational signals about hydraulic pressure and the like, and the detected current engine operating condition. Thus, the engagement state of each of lock pins 26, 27 is maintained during idling in which the discharge pressure from oil pump 20 is still unstable.

Subsequently to the above, immediately before the engine operating condition shifts to a low-speed low-load range or to a high-speed high-load range, as shown in FIGS. 16A-16B, spool valve element 52 slightly moves rightward (i.e., the sixth position) against the spring force of valve spring 53, responsively to a control current outputted from the electronic controller 37 to the electromagnetic coil 75. Hence, discharge passage 20*a* and lock passage 28 are communicated with each other through the internal passage hole 60, and simultaneously the fluid-communication state where phase-retard passage 18 and phase-advance passage 19 are both communicated with the discharge passage 20*a* is maintained.

Figure 7:
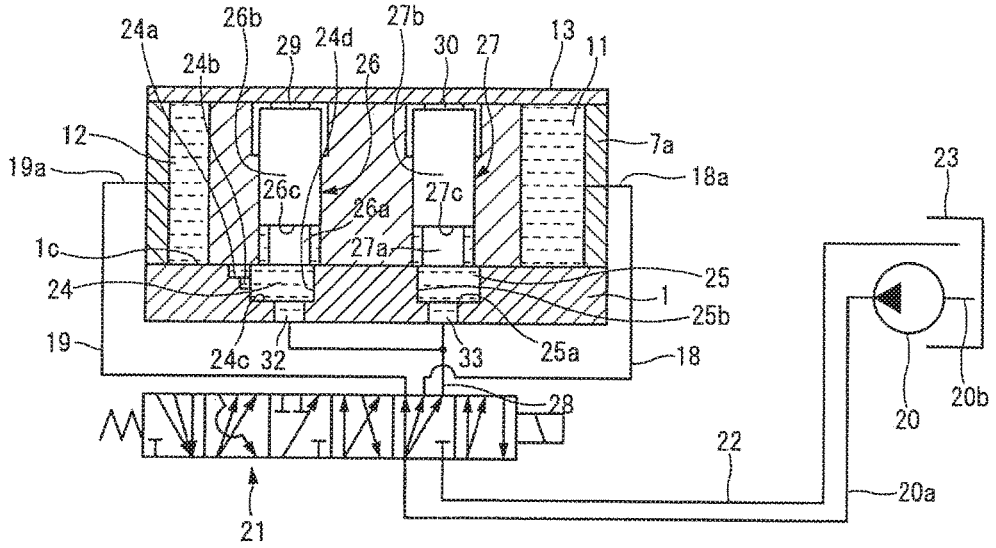
FIG. 7 is a cross-sectional view taken along the line B-B and the line C-C of FIG. 2 in combination and showing another operation of each of lock pins in the embodiment.

Therefore, working fluid (hydraulic pressure) is supplied through the lock passage 28 to each of pressure-receiving chambers 32, 33. Thus, as shown in FIG. 7, the supplied hydraulic pressures cause retreating movements of the tips 26*a*, 27*a* of lock pins 26, 27 out of engagement with respective lock holes 24, 25 against the spring forces of springs 29, 30. Hence, free rotation of vane rotor 9 in the normal-rotational direction or in the reverse-rotational direction is permitted, and simultaneously working fluid (hydraulic pressure) is supplied to both of hydraulic chambers 11, 12.

Hereupon, assuming that hydraulic pressure is supplied to either the hydraulic chamber 11 or the hydraulic chamber 12, vane rotor 9 tends to rotate in either one of the two opposite rotational directions. In this case, a so-called jammed (bitten) phenomenon in which the first and second lock pins 26, 27 have to receive respective shearing forces caused by circumferential displacements of the first and second pin holes 31*a*, 31*b* in the rotor portion 15 relative to the first and second lock holes 24, 25 occurs. Hence, there is a possibility that the locked (engaged) state cannot be rapidly released.

Alternatively, assuming that hydraulic pressure is supplied to neither the hydraulic chamber 11 nor the hydraulic chamber 12, vane rotor 9 tends to flutter by the previously-discussed alternating torque, and thus vane rotor 9 is brought into collision-contact with the shoe 10 of housing 7, and whereby there is an increased tendency for hammering noise to occur.

In contrast to the above, according to the embodiment, hydraulic pressure can be simultaneously supplied to both of hydraulic chambers 11, 12. Thus, it is possible to adequately suppress the jammed (bitten) phenomenon of the lock pins 26, 27 bit into the respective lock holes 24, 25, and also to adequately suppress the vane rotor from fluttering.

Thereafter, for instance when shifted to an engine low-speed low-load range, a larger control current is outputted to the electromagnetic selector valve 21. Hence, as shown in FIGS. 19A-19B, spool valve element 52 further moves rightward (i.e., the third position) against the spring force of valve spring 53. Thus, the fluid-communication state where lock passage 28 and phase-retard passage 18 are both communicated with the discharge passage 20*a* is maintained, and simultaneously phase-advance passage 19 and drain passage 22 are communicated with each other.

Figure 8:
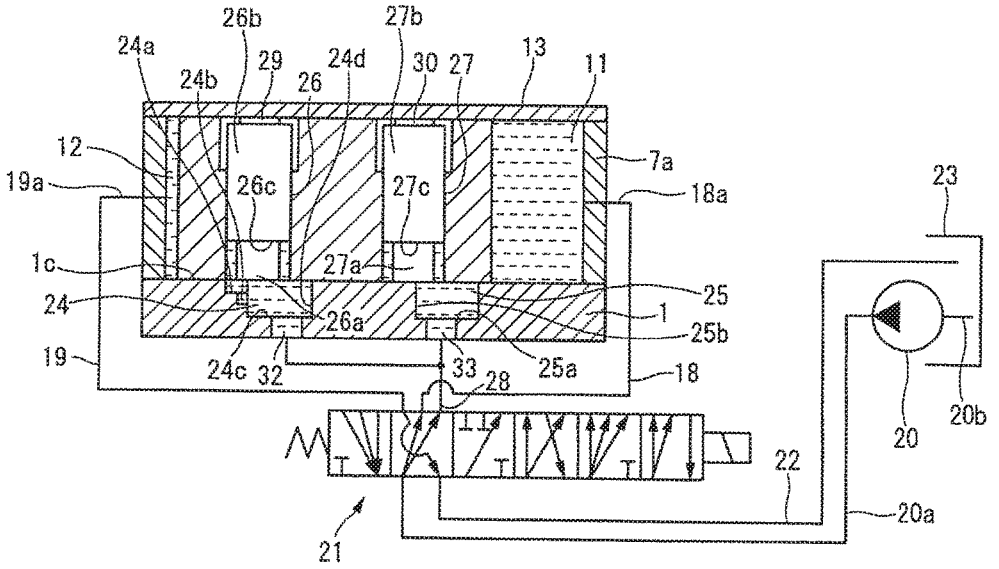
FIG. 8 is a cross-sectional view taken along the line B-B and the line C-C of FIG. 2 in combination and showing another operation of each of lock pins in the embodiment.

As a result of this, as shown in FIG. 8, lock pins 26, 27 are kept out of engagement with respective lock holes 24, 25. Also, as shown in FIG. 3, working fluid (hydraulic pressure) in phase-advance hydraulic chamber 12 is drained and thus hydraulic pressure in phase-advance hydraulic chamber 12 becomes low, whereas hydraulic pressure in phase-retard hydraulic chamber 11 becomes high. Accordingly, vane rotor 9 rotates relative to the housing 7 toward the maximum phase-retard side.

Accordingly, a valve overlap becomes small and thus the amount of in-cylinder residual gas also reduces, thereby enhancing a combustion efficiency and consequently ensuring stable engine revolutions and improved fuel economy.

Thereafter, when shifted to an engine high-speed high-load range, a small control current is supplied to the electromagnetic selector valve 21. Hence, as shown in FIGS. 17A-17B, spool valve element 52 moves leftward (i.e., the second position). As a result of this, phase-retard passage 18 and drain passage 22 are communicated with each other, and simultaneously lock passage 28 is kept in a fluid-communication relationship with the discharge passage 20*a*. At the same time, phase-advance passage 19 and discharge passage 20*a* are communicated with each other.

Figure 9:
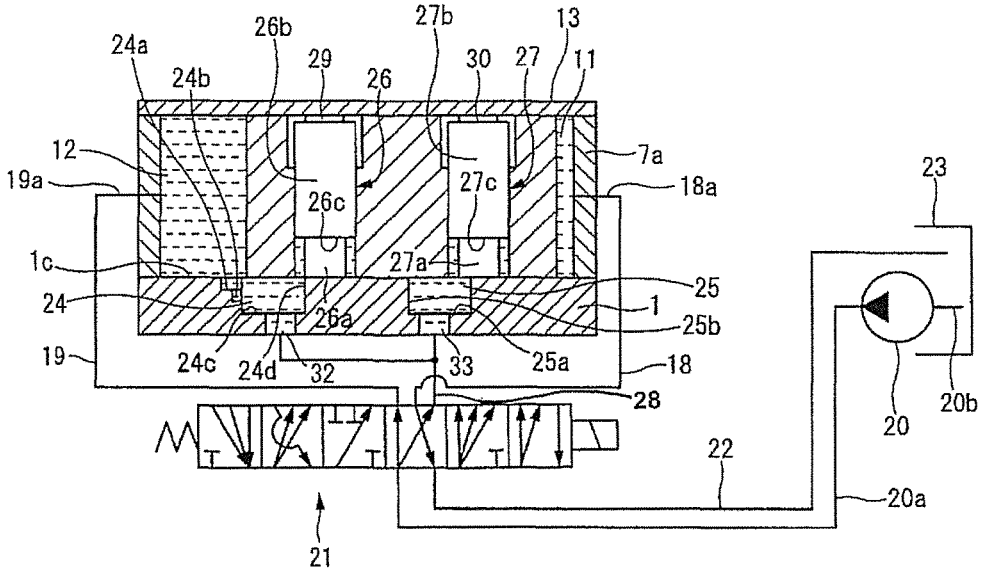
FIG. 9 is a cross-sectional view taken along the line B-B and the line C-C of FIG. 2 in combination and showing another operation of each of lock pins in the embodiment.

Therefore, as shown in FIG. 9, lock pins 26, 27 are kept out of engagement with the respective lock holes. Also, hydraulic pressure in phase-retard hydraulic chamber 11 becomes low, whereas hydraulic pressure in phase-advance hydraulic chamber 12 becomes high. Accordingly, as shown in FIG. 4, vane rotor 9 rotates relative to the housing 7 toward the maximum phase-advance side. Thus, the relative-rotation phase of camshaft 2 to sprocket 1 is converted into the maximum advanced relative-rotation phase.

Accordingly, a valve overlap of open periods of intake and exhaust valves becomes large and thus the intake-air charging efficiency is increased, thereby improving engine torque output.

Also, when shifted from the engine low-speed low-load range or the engine high-speed high-load range to the idling condition, a supply of control current from electronic controller 37 to the electromagnetic selector valve 21 is cut off. Hence, as shown in FIGS. 15A-15B, spool valve element 52 moves to the leftmost position (i.e., the first position) by the spring force of valve spring 53. Thus, lock passage 28 and drain passage 22 are communicated with each other, and simultaneously discharge passage 20*a* is communicated with both of phase-retard passage 18 and phase-advance passage 19. Accordingly, as shown in FIG. 6, hydraulic pressures having almost the same pressure value are applied to respective hydraulic chambers 11, 12.

For the reasons discussed above, even when vane rotor 9 has been positioned at a phase-retarded rotational position, rotary motion of the vane rotor toward the phase-advance side occurs owing to the previously-discussed alternating torque acting on camshaft 2. Hence, by the spring forces of springs 29, 30, advancing-movements of the first lock pin 26 and the second lock pin 27 occur, and then, by virtue of the previously-discussed ratchet action, the first lock pin and the second lock pin move into engagement with respective stepped lock holes 24, 25. This enables the angular position of vane rotor 9 to be held or locked at the intermediate phase position between the maximum phase-advance position and the maximum phase-retard position.

Also, when stopping the engine, the ignition switch is turned OFF. As previously described, lock pins 26, 27 are maintained in their engaged states without any movement of these lock pins out of engagement with respective lock holes 24, 25.

Furthermore, suppose that the engine is operating continuously in a given engine operating range, electromagnetic selector valve 21 is energized, and thus spool valve element 52 is displaced at a substantially middle axial position (i.e., the fourth position) shown in FIGS. 18A-18B. In this case, communication holes 64*b*, 64*c* are closed, and thus phase-retard passage 18 is communicated with neither of the discharge passage 20*a* and the drain passage 22 and also phase-advance passage 19 is communicated with neither of the discharge passage 20*a* and the drain passage 22. On the other hand, fluid-communication between discharge passage 20*a* and lock passage 28 is established.

Figure 10:
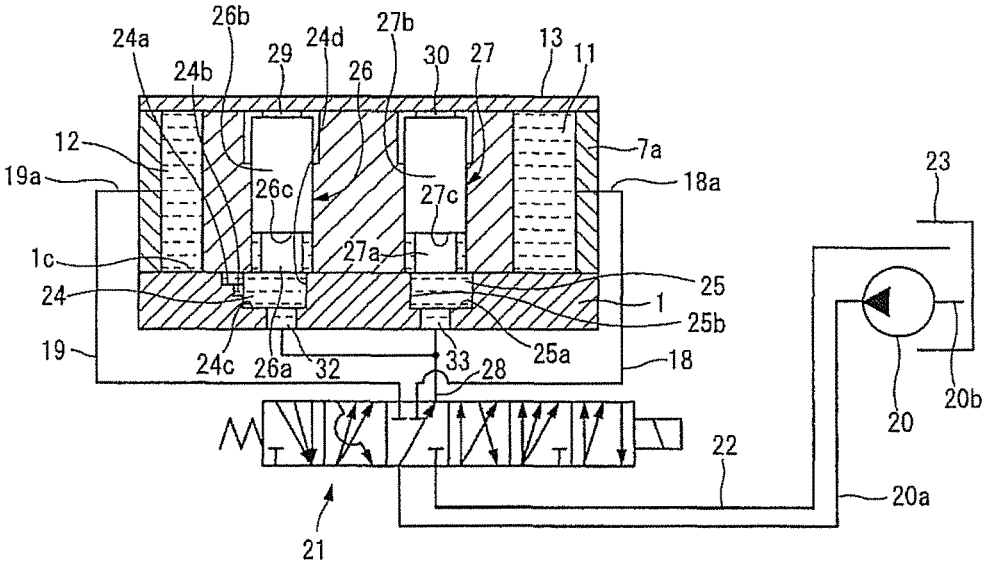
FIG. 10 is a cross-sectional view taken along the line B-B and the line C-C of FIG. 2 in combination and showing another operation of each of lock pins in the embodiment.

Hence, working fluid in each of phase-retard hydraulic chambers 11 and working fluid in each of phase-advance hydraulic chambers 12 are confined and held. Also, as shown in FIG. 10, lock pins 26, 27 are kept out of engagement with respective lock holes 24, 25 and hence the unlocked state is maintained.

Therefore, vane rotor 9 is held at a desired rotational position, and thus the relative rotational position of camshaft 2 to housing 7 is held at a desired relative rotational position. Accordingly, intake valve timing (valve open timing and valve closure timing) can be held at respective desired timing values.

In this manner, by energizing the electromagnetic selector valve 21 with a desired amount of control current or de-energizing the electromagnetic selector valve, by means of electronic controller 37 depending on an engine operating condition, and thus controlling axial movement of the spool valve element 52, the axial moving position of the spool valve element can be controlled to either one of the first, second, third, fourth, and sixth positions. Hence, the angular position of camshaft 2 to sprocket 1 can be controlled to a desired relative-rotation phase (an optimal relative rotational position) by controlling both of the phase conversion mechanism 3 and the position hold mechanism 4, thus more certainly enhancing the control accuracy of valve timing control.

Moreover, suppose that the axially moving spool valve element 52 of the energized electromagnetic selector valve 21 has been stuck due to contamination, dirt or debris (e.g., a very small piece of metal) contained in working fluid and jammed between the edge of each of lands 63*a*-63*f* and the edge of each of oil holes 56*a*-56*i*, when the engine has stopped abnormally due to an undesirable engine stall, or when restarting the engine after the engine has stopped normally. Owing to the sticking spool valve element, it is difficult to achieve selective switching among the ports, that is, a change in the path of flow through the electromagnetic selector valve. Under such an abnormal condition, that is, under a disabling state of sliding movement of the spool valve element, the control valve system operates as follows.

That is, when, due to the disabling state of sliding movement of spool valve element 52, as a matter of course, it is impossible to execute rotational phase control of vane rotor 9. The abnormal condition (i.e., the disabling state of movement of the spool valve element) is determined by electronic controller 37, based on the detected rotational position of camshaft 2. When the abnormal condition has been determined by means of the electronic controller, the controller generates a maximum energization amount of control current to the solenoid mechanism 54 of electromagnetic selector valve 21. As a result of this, as shown in FIGS. 20A-20B, the spool valve element 52 is forcibly displaced toward the rightmost position (i.e., the fifth position) by a maximum magnitude of electromagnetic force, while shearing the contamination or debris. Hence, all of phase-retard passage 18, phase-advance passage 19, and lock passage 28 communicate with the drain passage 22, and as a result working fluid in each of hydraulic chambers 11, 12, and working fluid in each of pressure-receiving chambers 32, 33 are all drained into the oil pan 23.

For the reasons discussed above, even when vane rotor 9 has been positioned at a phase-retard side with respect to the intermediate phase position, vane rotor 9 tends to rotate in the phase-advance direction owing to the previously-discussed negative alternating torque. Hence, as shown in FIG. 5, by virtue of the ratchet action, lock pins 26, 27 rapidly move into engagement with respective lock holes 24, 25. Hence, the angular position of camshaft 2 is held at the intermediate rotational phase between the maximum phase-retarded position and the maximum phase-advanced position.

As set forth above, in fixing the sleeve 51 to the valve body 50 in the shown embodiment, the sleeve is positioned and fixed through the use of the retaining member 69 and the seal member 68 without using shrinkage fit. Hence, it is possible to suppress the sleeve 51 from being heat-affected and deformed. As a result of this, it is possible to ensure a constantly smooth slidability of the spool valve element.

Additionally, the previously-mentioned seal member 68 is elastically deformable, thus enabling stable positioning of sleeve 51 in the axial direction.

In addition to the positioning function, seal member 68 has a fluid-tight seal function between the outer surface of the tip of the body part 57*a* of check valve 57 and the inner surface of the tip 50*a* of valve body 50. Thus, it is possible to permit the working fluid to flow only in the direction of the filter member 58, without any leak of the discharged working oil flown into the introduction port 50*b* between them.

Furthermore, in the shown embodiment, the valve body 50 of electromagnetic selector valve 21 is also utilized as the cam bolt, and thus the total size of the valve timing control device can be reduced.

Hitherto, the male screw part was formed on the male screw-threaded structural part of the tip of the valve body so as to extend from the tip. In contrast, in the shown embodiment, the male screw part 50*f*, which is formed on the outer peripheral surface of valve body 50, is formed or configured, utilizing a specified part of the outer peripheral surface of the main valve-body part of valve body 50 without forming on such a male screw-threaded structural part arranged at the tip of the valve body. That is, the male screw part 50*f* is formed on the specified part of the outer peripheral surface of the main valve-body part, the specified part ranging to overlap with the tip 52*a* of spool valve element 52. Hence, the axial length of valve body 50 can be reduced as much as possible.

As a result of this, the entire axial length of the device can be shortened, thus improving the layout flexibility inside of the engine room, and enhancing the mountability of the device inside of the engine room.

Additionally, by virtue of the specific configuration of valve body 50, the axial length of the bolt hole 2*b* of the one end 2*a* of camshaft 2 can be shortened, and therefore it is possible to suppress a reduction in the rigidity of the one end 2*a* of camshaft 2, in particular, a reduction in the torsional rigidity.

Hence, the support rigidity for supporting the vane rotor 9 can be improved, and thus it is possible to stably support the vane rotor, and also to improve the ability to transmit rotation from the vane rotor 9 to the camshaft 2.

Moreover, by virtue of the shortened axial length and the simplified longitudinal cross-sectional shape of bolt hole 2*b*, thereby facilitating the boring work of camshaft 2.

Also, the outside diameter of the tip 50*a* of valve body 50 is formed less than the inside diameter of the bolt hole 2*b* of camshaft 2, such that a space is defined between them. Thus, it is possible to form the previously-mentioned oil hole 40, utilizing the defined space. Hence, it is possible to simplify the flow path configuration structured by the oil chamber 40 and the introduction port 50*b*.

As discussed previously, the axial length of solenoid mechanism 54 is formed shorter than its outside diameter, and thereby configured as a flat solenoid shape. By means of this, the entire axial length of the device can be shortened.

Also, in the shown embodiment, as a preparatory phase for disengaging lock pins 26, 27 from respective lock holes 24, 25, spool valve element 52 is controlled to the first position shown in FIGS. 15A-15B. Thus, working fluid in each of the first pressure-receiving chamber 32 and the second pressure-receiving chamber 33 is drained, and simultaneously working fluid is supplied to both of each phase-retard chamber 11 and each phase-advance chamber 12. Accordingly, by virtue of relative hydraulic pressures to hydraulic chambers 11, 12, which pressures have almost the same pressure value, fluttering motion of vane rotor 9 can be suppressed, and also rotary motion of the vane rotor in either one of the rotational directions can be suppressed.

Subsequently to the above, when working-fluid supply to each of pressure-receiving chambers 32, 33 begins to occur by moving the spool valve element 52 to the sixth position, any shearing forces do not yet act the lock pins 26, 27 in their shearing directions owing to the previously-supplied working fluid to hydraulic chambers 11, 12. This ensures smooth, easy disengagement of the lock pins from the respective lock holes 24, 25.

Also, in the shown embodiment, two functions, namely a hydraulic-pressure control function for each of hydraulic chambers 11, 12 and a hydraulic-pressure control function for each of unlocking pressure-receiving chambers 32, 33 can be both achieved by means of the single electromagnetic selector valve 21. Hence, it is possible to improve the layout flexibility on the engine body, thus realizing lower costs.

Furthermore, by means of the position hold mechanism 4, it is possible to improve the ability to hold the vane rotor 9 at the intermediate phase position. Also, by virtue of the bottom faces 24*a*-24*c* of the stepped lock guide groove of lock hole 24, the first lock pin 26 can be necessarily guided and moved only in the direction of lock hole 24, thus securing both the reliability and the stability.

Hydraulic pressure in each of hydraulic chambers 11, 12 never serves as hydraulic pressure applied to each of pressure-receiving chambers 32, 33. As compared to the case where hydraulic pressure in each of hydraulic chambers 11, 12 also serves as hydraulic pressure applied to each of the pressure-receiving chambers, it is possible to improve a better supply responsiveness of hydraulic-pressure supply to each of pressure-receiving chambers 32, 33, thereby improving the responsiveness of retreating movement of each of lock pins 26, 27. Additionally, this eliminates the necessity of providing a seal mechanism between each of hydraulic chambers 11, 12 and each of pressure-receiving chambers 32, 33.

Additionally, when the first lock pin 26 has been brought into engagement with the first lock hole 24, the edge of the outer circumference of the tip 26*a* can be finally brought into abutted-engagement with the inner face 24*d* of the third bottom face 24*c* having a comparatively larger area. In view of the above, it is possible to enhance the durability.

Also, in the shown embodiment, the position hold mechanism 4 is classified and divided into two lock sections, that is, one being the first lock section having the first lock pin 26 and the first to third bottom faces 24*a*-24*c*, and the other being the second lock section having the second lock pin 27 and the bottom face 25*a*. Hence, it is possible to reduce the thickness of sprocket 1 in which each of lock holes 24, 25 is formed. That is to say, suppose that the lock mechanism is constructed by a single lock pin, and as a result a plurality of stepped bottom faces including bottom faces 24*a*-24*c* or more have to be continuously formed. In such a case, in order to assure the height of all the stepped bottom faces, the thickness of the sprocket body has to be increased. In contrast, in the case that the position hold mechanism (the lock mechanism) is divided into two lock sections as discussed previously, it is possible to reduce the thickness of the sprocket body. Hence, it is possible to shorten the axial length of the valve timing control device, thus improving the layout flexibility.

While the foregoing is a description of the preferred embodiments carried out the invention, it will be understood that the invention is not limited to the particular embodiments shown and described herein, but that various changes and modifications may be made. Regarding an actuator, in the embodiment, an electromagnetic force produced by the solenoid mechanism 54 is used. In lieu thereof, for instance, the device may be hydraulically actuated by hydraulic pressure.

In the shown embodiment, relative-rotation position of camshaft 2 to sprocket 1 can be locked at the intermediate relative-rotation position (the intermediate lock position) by the use of the lock mechanism (the position hold mechanism). Alternatively, the control valve may be applied to a device in which such a lock mechanism is eliminated and hence the valve timing is merely controlled to either a maximum phase-retard position or a maximum phase-advance position.

In the case of such a non-lock-mechanism equipped device, there is no necessity of a lock passage, a lock port and the like. Hence, it is possible to shorten the axial length of the previously-discussed electromagnetic selector valve 21, and hence it is possible to further shorten the entire axial length of the device.

As the previously-discussed elastic member (the seal member), a typical O ring may be used. In lieu thereof, a spring member, such as a coned disc spring or a coiled spring, may be used.

Also, as the previously-discussed retaining member, an elastically-deformed fastener, such as a snap ring, which is fitted and fixed to the inner periphery of the rear end opening of valve body 50, may be used. Alternatively, the retaining member may be formed by a disk-shaped member made of a synthetic resin material.

Moreover, the valve timing control device may be applied to the exhaust side as well as the intake side.

REFERENCE SIGNS LIST

1 . . . Sprocket
2 . . . Camshaft
2*a* . . . One end
2*b* . . . Bolt hole
3 . . . Phase conversion mechanism
4 . . . Position hold mechanism
5 . . . Hydraulic circuit
7 . . . Housing
7*a* . . . Housing main body
8 . . . Cam bolt
9 . . . Vane rotor
11 . . . Phase-retard hydraulic chamber
12 . . . Phase-advance hydraulic chamber
16*a*-16*c* . . . Vanes
18 . . . Phase-retard passage
19 . . . Phase-advance passage
18*a* . . . Phase-retard passage hole (Phase-retard port)
19*a* . . . Phase-advance passage hole (Phase-advance port)
20 . . . Oil pump
20*a* . . . Discharge passage
21 . . . Electromagnetic selector valve (Control valve)
22 . . . Drain passage
24 . . . First lock hole
25 . . . Second lock hole
26 . . . First lock pin
27 . . . Second lock pin
28 . . . Lock passage
29, 30 . . . Springs (Biasing members)
31*a*, 31*b* . . . First and second pin holes
32, 33 . . . First and second unlocking pressure-receiving chambers
37 . . . Electronic controller
40 . . . Oil hole
50 . . . Valve body
50*a* . . . Tip
50*b* . . . Introduction port
50*c* . . . Lock port
50*d* . . . Rear end opening wall
50*e* . . . Retaining groove
50*f* . . . Male screw part (Fixing part)
51 . . . Sleeve
52 . . . Spool valve element
53 . . . Valve spring (Biasing member)
54 . . . Solenoid part
55*a*, 55*f*, 55*h* . . . Supply passage grooves
55*b*, 55*c* . . . Phase-retard and phase-advance passage grooves
55*d* . . . Lock passage groove
55*e*, 55*g* . . . Drain passage grooves
56*a*-56*i* . . . Oil holes
57 . . . Check valve
57*a* . . . Body part
57*b* . . . Ball valve element
58 . . . Filter member
61 . . . Plug
62*a*, 62*b* . . . Guide parts
63*a*-63*f* . . . Lands
64*a*-64*d* . . . Communication holes
65*a*-65*c* . . . Annular grooves
68 . . . Seal member (Elastic member)
69 . . . Retaining member
69*a* . . . Drain hole (Through hole)

The invention claimed is:

1. A control valve for a valve timing control device equipped with a driving rotary member adapted to receive a rotational force transmitted from a crankshaft and having an operating chamber formed therein, and a driven rotary member fixed to one axial end of a camshaft and rotatably housed in the driving rotary member so as to partition the operating chamber into a phase-advance working chamber and a phase-retard working chamber, and configured to relatively rotate to either a phase-advance side or a phase-retard side with respect to the driving rotary member by supply and discharge of working fluid for both of the working chambers, the control valve comprising:

a cylindrical valve body configured to axially fixedly connect the driven rotary member to the camshaft;

a sleeve fixedly connected to an inner periphery of the valve body; and a spool valve element axially slidably housed in the sleeve and configured to perform switching between supply and discharge of the working fluid to and from each of the working chambers, wherein the valve body has a male screw part formed on an outer peripheral surface of the valve body, and an introduction port, into which working fluid from a discharge passage of an oil pump driven by an internal combustion engine is introduced, the introduction port being formed at an axial distal end of the valve body, wherein the sleeve has passage grooves formed in an outer peripheral surface along an axial direction and configured to communicate with the introduction port, and oil holes formed as radial through holes at positions substantially corresponding to the passage grooves, and wherein the male screw part, the sleeve, and the spool valve element are arranged to overlap with each other in an axial cross-section of the valve body.

2. The control valve for the valve timing control device as recited in claim 1, wherein:

an outside diameter of the axial distal end of the valve body is formed to be less than an outside diameter of the male screw part.

3. The control valve for the valve timing control device as recited in claim 2, wherein:

the valve body further comprises:

a phase-advance port configured to supply and discharge working fluid for the phase-advance working chamber;

a phase-retard port configured to supply and discharge working fluid for the phase-retard working chamber;

a lock port configured to supply and discharge working fluid for a lock mechanism disposed between the phase-advance working chamber and the phase-retard working chamber and configured to release a locked state of the driving rotary member and the driven rotary member by a supplied hydraulic pressure; and a drain port configured to drain working fluid from the phase-advance working chamber, the phase-retard working chamber, and the lock mechanism to an exterior.

4. The control valve for the valve timing control device as recited in claim 3, which further comprises:

a filter member configured to filter working fluid introduced through the introduction port.

5. The control valve for the valve timing control device as recited in claim 3, which further comprises:

a check valve disposed in the axial distal end of the valve body, the check valve being configured to restrict a backflow of working fluid from within the valve body through the introduction port to the exterior.

6. The control valve for the valve timing control device as recited in claim 2, wherein:

the sleeve is elastically supported axially in the valve body by a seal elastically interposed between an outer surface of a top end of the sleeve and an inner surface of the axial distal end of the valve body and a retainer fixed at a position opposite to the axial distal end of the valve body and having a central through hole.

7. The control valve for the valve timing control device as recited in claim 2, wherein:

the valve body further comprises:

a phase-advance port configured to supply and discharge working fluid for the phase-advance working chamber;

a phase-retard port configured to supply and discharge working fluid for the phase-retard working chamber; and a drain port configured to drain working fluid from the phase-advance working chamber and the phase-retard working chamber to an exterior.

8. The control valve for the valve timing control device as recited in claim 1, wherein:

a movement of the spool valve element is controlled by an actuator arranged at a position opposite to the axial distal end of the valve body.

9. The control valve for the valve timing control device as recited in claim 8, wherein:

the spool valve element is configured to move in one direction within the valve body by a driving force of the actuator and to move in a direction opposite to the one direction by a spring.

10. The control valve for the valve timing control device as recited in claim 9, wherein:

the actuator and the spool valve element are kept in abutted-engagement with each other through a cylindrical plug attached to an axial end of the spool valve element.

11. The control valve for the valve timing control device as recited in claim 10, wherein:

the actuator is constructed by a flat solenoid mechanism whose axial length is dimensioned to be less than an outside diameter.

12. The control valve for the valve timing control device as recited in claim 9, wherein:

the spring is arranged proximate to the male screw part.

13. A valve timing control device for an internal combustion engine, comprising:

a driving rotary member adapted to receive a rotational force transmitted from a crankshaft and having an operating chamber formed therein;

a driven rotary member fixed to one axial end of a camshaft and rotatably housed in the driving rotary member so as to partition the operating chamber into a phase-advance working chamber and a phase-retard working chamber, and configured to relatively rotate to either a phase-advance side or a phase-retard side with respect to the driving rotary member by supply and discharge of working fluid for both of the working chambers; and a control valve configured to perform supply-and-discharge control of the working fluid force-fed from an oil pump to and from each of the working chambers, the control valve comprising:

a cylindrical valve body having a male screw part formed on an outer peripheral surface of the valve body for fixing the driven rotary member to the camshaft;

a sleeve fixedly connected to an inner periphery of the valve body;

a spool valve element axially slidably housed in the sleeve and configured to perform switching between supply and discharge of the working fluid to and from each of the working chambers; and an actuator configured to control a movement of the spool valve element, wherein the valve body has an introduction port, into which working fluid from a discharge passage of the oil pump driven by the internal combustion engine is introduced, the introduction port being formed at an axial distal end of the valve body, wherein the sleeve has passage grooves formed in an outer peripheral surface along an axial direction and configured to communicate with the introduction port, and oil holes formed as radial through holes at positions substantially corresponding to the passage grooves, and wherein the male screw part, the sleeve, and the spool valve element are arranged to overlap with each other in an axial cross-section of the valve body.

14. The valve timing control device for the internal combustion engine as recited in claim 13, wherein:

the valve body further comprises:

a phase-advance port configured to supply and discharge working fluid for the phase-advance working chamber;

a phase-retard port configured to supply and discharge working fluid for the phase-retard working chamber;

a lock port configured to supply and discharge working fluid for a lock mechanism disposed between the phase-advance working chamber and the phase-retard working chamber and configured to release a locked state of the driving rotary member and the driven rotary member by a supplied hydraulic pressure; and a drain port configured to drain working fluid from the phase-advance working chamber, the phase-retard working chamber, and the lock mechanism to an exterior.

* * * * *